US008494416B2

(12) United States Patent
Sugiyama

(10) Patent No.: US 8,494,416 B2
(45) Date of Patent: Jul. 23, 2013

(54) IMAGE FORMING APPARATUS AND IMAGE FORMING SYSTEM

(75) Inventor: Yasuhisa Sugiyama, Tokyo (JP)

(73) Assignee: Oki Data Corporation, Tokyo (JP)

( * ) Notice: Subject to any disclaimer, the term of this patent is extended or adjusted under 35 U.S.C. 154(b) by 525 days.

(21) Appl. No.: 12/729,313

(22) Filed: Mar. 23, 2010

(65) Prior Publication Data

US 2010/0239321 A1 Sep. 23, 2010

(30) Foreign Application Priority Data

Mar. 23, 2009 (JP) ..... 2009-070221

(51) Int. Cl.
*G03G 15/08* (2006.01)
*G03G 21/00* (2006.01)

(52) U.S. Cl.
USPC ..... 399/231; 399/53; 399/223; 399/366

(58) Field of Classification Search
USPC ..... 399/45, 47, 53, 54, 222–224, 226, 399/231, 365, 366
See application file for complete search history.

(56) References Cited

U.S. PATENT DOCUMENTS

| | | | | |
|---|---|---|---|---|
| 2008/0318145 | A1 * | 12/2008 | Hu et al. | 430/48 |
| 2009/0016776 | A1 * | 1/2009 | Priebe et al. | 399/231 |
| 2009/0067905 | A1 * | 3/2009 | Fisher et al. | 399/361 |

FOREIGN PATENT DOCUMENTS

| | | | |
|---|---|---|---|
| JP | 04-155361 | | 5/1992 |
| JP | 06-164914 | | 6/1994 |
| JP | 2001-096889 | A | 4/2001 |
| JP | 2003-326879 | A | 11/2003 |
| JP | 2007-083448 | A | 4/2007 |
| JP | 2008-020782 | A | 1/2008 |
| JP | 2008-188974 | A | 8/2008 |
| JP | 2008-219368 | A | 9/2008 |
| JP | 2008-224712 | A | 9/2008 |
| JP | 2009-025713 | A | 2/2009 |
| WO | 2006040832 | A1 | 4/2006 |

* cited by examiner

*Primary Examiner* — Walter L Lindsay, Jr.
*Assistant Examiner* — Jessica L Eley
(74) *Attorney, Agent, or Firm* — Panitch Schwarze Belisario & Nadel LLP

(57) ABSTRACT

An image forming apparatus includes a first development unit, a second development unit, and a control unit. The first development unit forms a first developer image with a first developer absorbing a light having a prescribed wavelength. The second development unit forms a second developer image with a second developer permeating the light having prescribed wavelength therethrough. The control unit controls print of a background design image by the first development unit and print of a print image by the second development unit.

16 Claims, 18 Drawing Sheets

IMAGE FORMING APPARATUS AND IMAGE FORMING SYSTEM

BACKGROUND OF THE INVENTION

1. Field of the Invention

The present invention relates to an image forming apparatus and an image forming system capable of forming a print image on a medium to be used for a printer, a photocopier, a facsimile device, and the like.

2. Description of Related Art

A related art image forming apparatus, such as a printer, a photocopier, and a multifunctional device employing an electrophotographic method, an ink jet method, or a heat transfer method, forms a background design pattern based on prescribed information and prints a print image by superimposing on the background design pattern, thereby reducing (if not prevent) a leakage of important document data.

Patent Document 1, for example, discloses formation of an image on the medium by combining print data serving as a readable image and background design pattern data formed based on embedded information provided by analyzing and re-editing data transmitted from an upper-level device.

Patent Document 1: Japanese Unexamined Patent Application Publication No. 2008-219368

The image forming apparatus disclosed in Patent Document 1 allows the image expressed by the background design pattern data and the image expressed by the print data to be superimposed and printed on the medium. Consequently, the information provided on the background design pattern becomes difficult to be read in a portion in which the image of the background design pattern data and the image of print data are superimposed, causing a limitation of a printable region for the background design pattern due to the print data.

The present invention is proposed in consideration of the aforementioned situations, and provides an image forming apparatus and an image forming system capable of removing a print restriction with respect to print data serving as a readable image in a printable region for a background design pattern.

BRIEF SUMMARY OF THE INVENTION

According to an aspect of the present invention, an image forming apparatus includes: a first development unit forming a first developer image with a first developer absorbing a light having a prescribed wavelength; a second development unit forming a second developer image with a second developer permeating the light having prescribed wavelength therethrough; and a control unit controlling print of a background design image by the first development unit and print of a print image by the second development unit.

According to another aspect of the present invention, an image forming system includes: an image forming apparatus including a first development unit forming a first developer image with a first developer absorbing a light having a prescribed wavelength, a second development unit forming a second developer image with a second developer permeating the light having prescribed wavelength therethrough, and a control unit controlling print of a background design image by the first development unit and print of a print image by the second development unit; and an image reading apparatus reading the background design image using the light having the prescribed wavelength.

Additional features and advantages of the present invention will be more fully apparent from the following detailed description of embodiments, the accompanying drawings and the associated claims.

BRIEF DESCRIPTION OF THE DRAWINGS

A more complete appreciation of the aspects of the present invention and many of the attendant advantage thereof will be readily obtained as the same becomes better understood by reference to the following detailed description when considered in connection with the accompanying drawings, wherein.

DETAILED DESCRIPTION OF PREFERRED EMBODIMENTS

Figure 1:
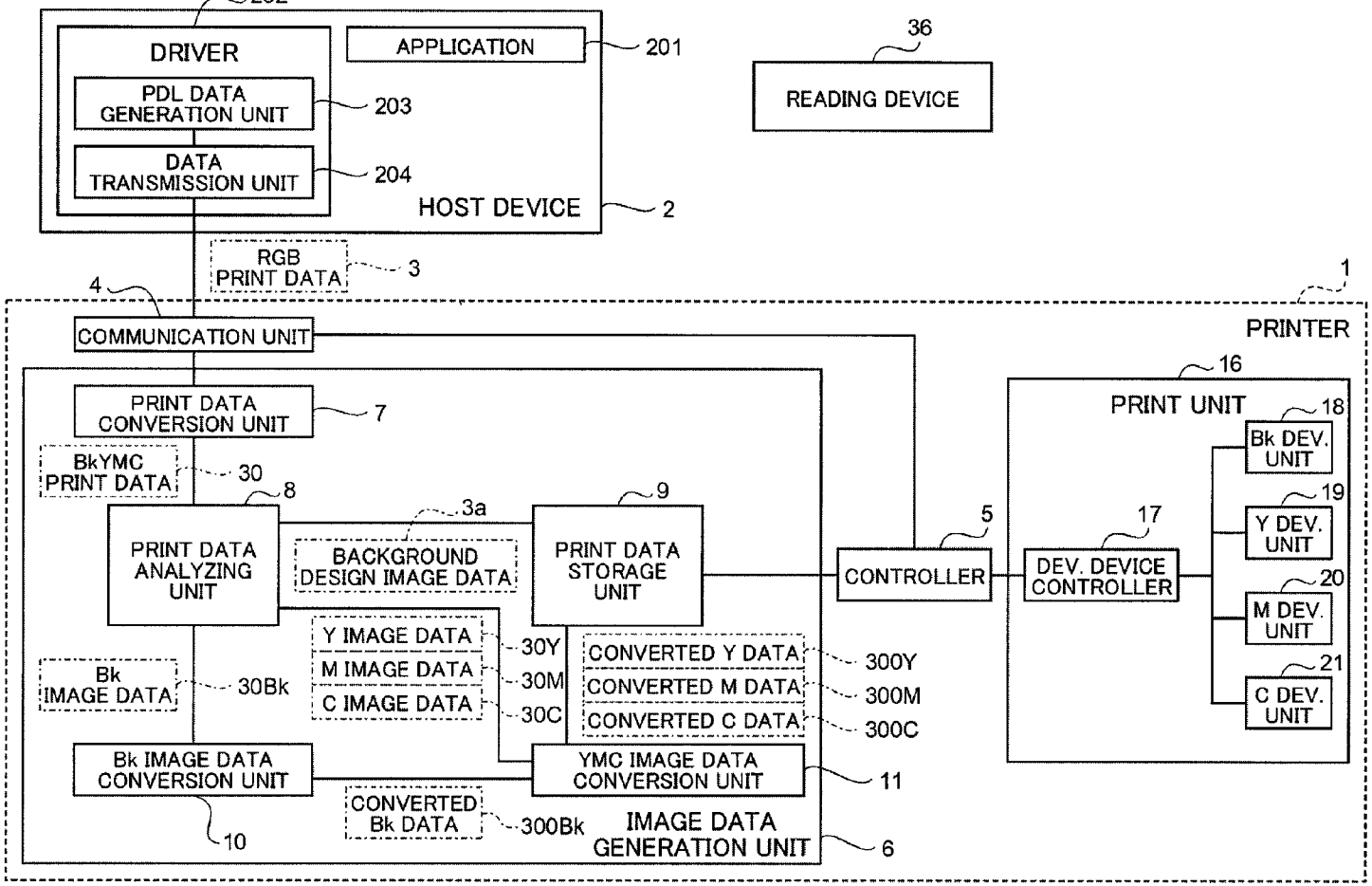
FIG. 1 is a schematic block diagram illustrating an image forming system according to a first embodiment of the present invention.

An image forming apparatus and an image forming system according to preferred embodiments of the present invention are now described more fully hereinafter with reference to the accompanying drawings. The present invention may, however, be embodied in many different forms and should not be construed as limited to the embodiments set forth herein. The embodiments, therefore, may be modified or varied without departing from the scope of the present invention.

In describing embodiments illustrated in the drawings, specific terminology is employed for the sake of clarity. However, the disclosure of the patent specification is not intended to be limited to the specific terminology so selected, and it is to be understood that each specific element includes all technical equivalents that operate in a similar manner. Preferred embodiments of the present invention are described in detail referring to the drawings, wherein like reference numerals designate identical or corresponding parts throughout the several views.

First Embodiment

A description is given of an image forming system including a printer 1 serving as an image forming apparatus according to a first embodiment of the present invention.

Referring to FIG. 1, the image forming system includes: the printer 1; a higher-level device or host device 2 connected to the printer 1 through an electrical connection mechanism such as a signal cable to transmit RGB print data designated with respect to the printer 1; and a reading device 36 reading a pattern image formed based on background design image data printed on a medium S. The pattern image is hereafter referred to as a background design pattern image. According to the first embodiment, the medium S is described as a sheet such as a printing sheet. However, the medium S is not limited to thereto. For example, the medium S may be an intermediate transfer belt.

The host device 2, for example, includes: a hardware (not shown) including a central processing unit (CPU), a storage device such as a random access memory (RAM) and a hard disk device (HDD), and an input device such as a keyboard and a mouse; an application 201 preparing output data formed of a background design image and a color image based on information input by a user through the input device; and a driver 202. The driver 202 includes: a page description language (PDL data) data generation unit 203 generating RBG print data 3 based on the output data prepared by the application 201; and a data transmission unit 204 transmitting the RGB print data 3 with respect to the printer 1. The host device 2 is, for example, a personal computer.

Figure 2:
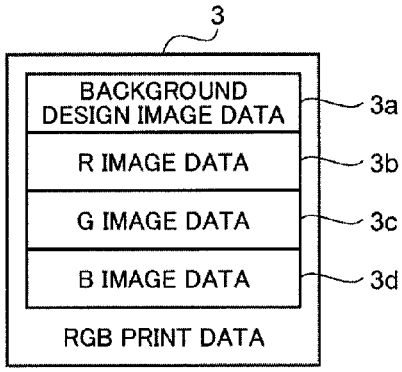
FIG. 2 is a schematic diagram illustrating RGB print data.
Figure 3:
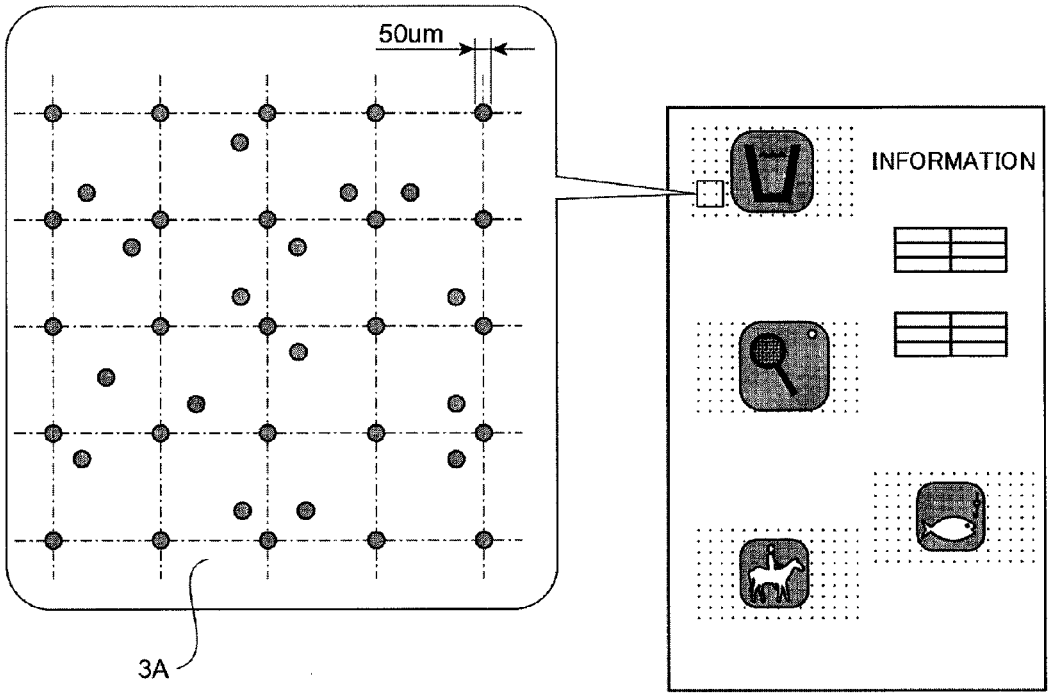
FIG. 3 is a schematic diagram illustrating a background design pattern image.

The RGB print data 3 is now described with reference to FIG. 2. The RGB print data 3 include: background design image data 3*a* generated from on the background design image; red image data 3*b* generated from the color image; green image data 3*c* generated from the color image; blue image data 3*d* generated from the color image; and print job data (not shown). The red, green, and blue colors are hereafter respectively abbreviated as R, Q and B as necessary. The print job data include an identifier (not shown) identifying whether or not the RGB print data 3 include the background design image data 3*a*. According to the first embodiment, a background design pattern image 3A, serving as a pattern image, is expressed by the background design image data 3*a*, and includes dots each of which has a size of approximately 50 μm to 100 μm as illustrated in FIG. 3. The dots are arranged in prescribed locations in the pattern image, thereby providing character information and the like.

A description is now given of the printer 1. The printer 1 includes: a communication unit 4, a control unit 5, an image data generation unit 6, and a print unit 16.

Figure 4:
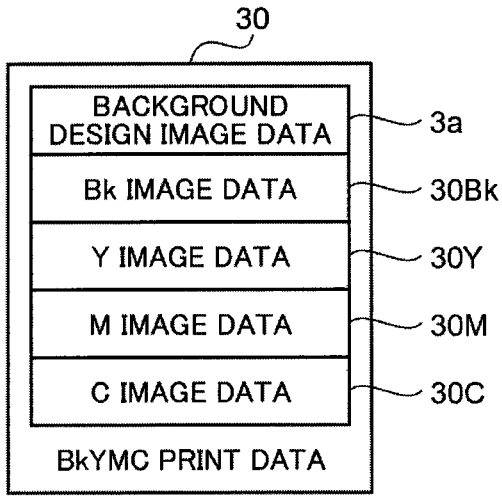
FIG. 4 is a schematic diagram illustrating BkYMC print data.

The communication unit 4, for example, allows the printer 1 and the host device 2 to be connected using the electrical connection mechanism to transmit and receive the data. The control unit 5 controls operation of the printer 1 as a whole. The image data generation unit 6 generates BkYMC print data 30 from the RGB print data 3 received from the host device 2 and converts the BkYMC print data 30 into image data to be formed into an image by the print unit 16. The print unit 16 prints the image based on the image data of each color forming the BkYMC print data 30 generated by the image data generation unit 6. Herein, the BkYMC print data 30 include the background design image data 3*a*, black image data 30Bk, yellow image data 30Y, magenta image data 30M, and cyan image data 30C as illustrated in FIG. 4. The black, yellow, magenta, and cyan colors are respectively abbreviated as Bk, Y, M, and C as may be needed.

The image data generation unit 6 is now described. The image data generation unit 6 includes a print data conversion unit 7, a print data analyzing unit 8, a print data storage unit 9, a Bk image data conversion unit 10, and a YMC image data conversion unit 11.

The print data conversion unit 7 converts the RGB print data 3 received through the communication unit 4 into the BkYMC print data 30 capable of being processed by the printer 1.

The print data analyzing unit 8 not only analyzes the BkYMC print data 30 converted by the print data conversion unit 7, but also transfers the image data to the conversion units of respective colors.

The print data storage unit 9 stores therein the image data processed by the conversion units of respective colors.

The Bk image data conversion unit 10 unitizes the black image data 30Bk, serving as the image data of the black image, into units of prescribed density and performs a conversion process by allowing the black image data 30Bk to be allocated to each of the yellow, magenta, and cyan colors in response to each of the density units.

The YMC image data conversion unit 11 performs conversion processes of the yellow image data 30Y, the magenta image data 30M, and the cyan image data 30C.

As illustrated in FIG. 1, converted black image data 300Bk indicate conversion data having been undergone the conversion process in the Bk image data conversion unit 10. Similarly, converted yellow image data 300Y, converted magenta image data 300M, and converted cyan image data 300C indicate conversion data having been undergone the conversion processes of the respective yellow image data 30Y, magenta image data 30M, and cyan image data 30C in the conversion process in the YMC image data conversion unit 11. For example, in a case where a black image having a density of 50% is expressed by the YMC image data, the conversion of the black image data 30Bk by the Bk image data conversion unit 10 is performed in such a manner that the images of respective colors are superimposed one on another using an allocation rate of 40% for yellow, 40% for magenta, and 40% for cyan in the same position on a pixel. Such an allocation rate is an example rate for the conversion of the black image data into the YMC image data, and can be changed to adjust color tone and density of the image to be formed after the conversion. Since the allocation rate is influenced by characteristics of each color developer or the printer, the allocation rate is preferably determined beforehand with respect to each device.

A description of the printer unit 16 is now described with reference to FIGS. 1 and 5. The printer unit 16 includes: a development device control unit 17; a black development unit 18 corresponding to the black color; a yellow development unit 19 corresponding to the yellow color; a magenta development unit 20 corresponding to the magenta color; and a cyan development unit 21 corresponding to the cyan color.

The development device control unit 17 controls each of the Bk development unit 18, the Y development unit 19, the M development unit 20, and the C development unit 21 based on the control by the control unit 5.

Each of the Bk development unit 18, the Y development unit 19, the M development unit 20, and the C development unit 21 serves as a development unit disposed in the print unit 16. Since each of the Bk development unit 18, the Y development unit 19, the M development unit 20, and the C development unit 21 is substantially similar to one another except the color of the toner, the Bk development unit 18 is described as representative of all development units 18, 19, 20, and 21.

Figure 5:
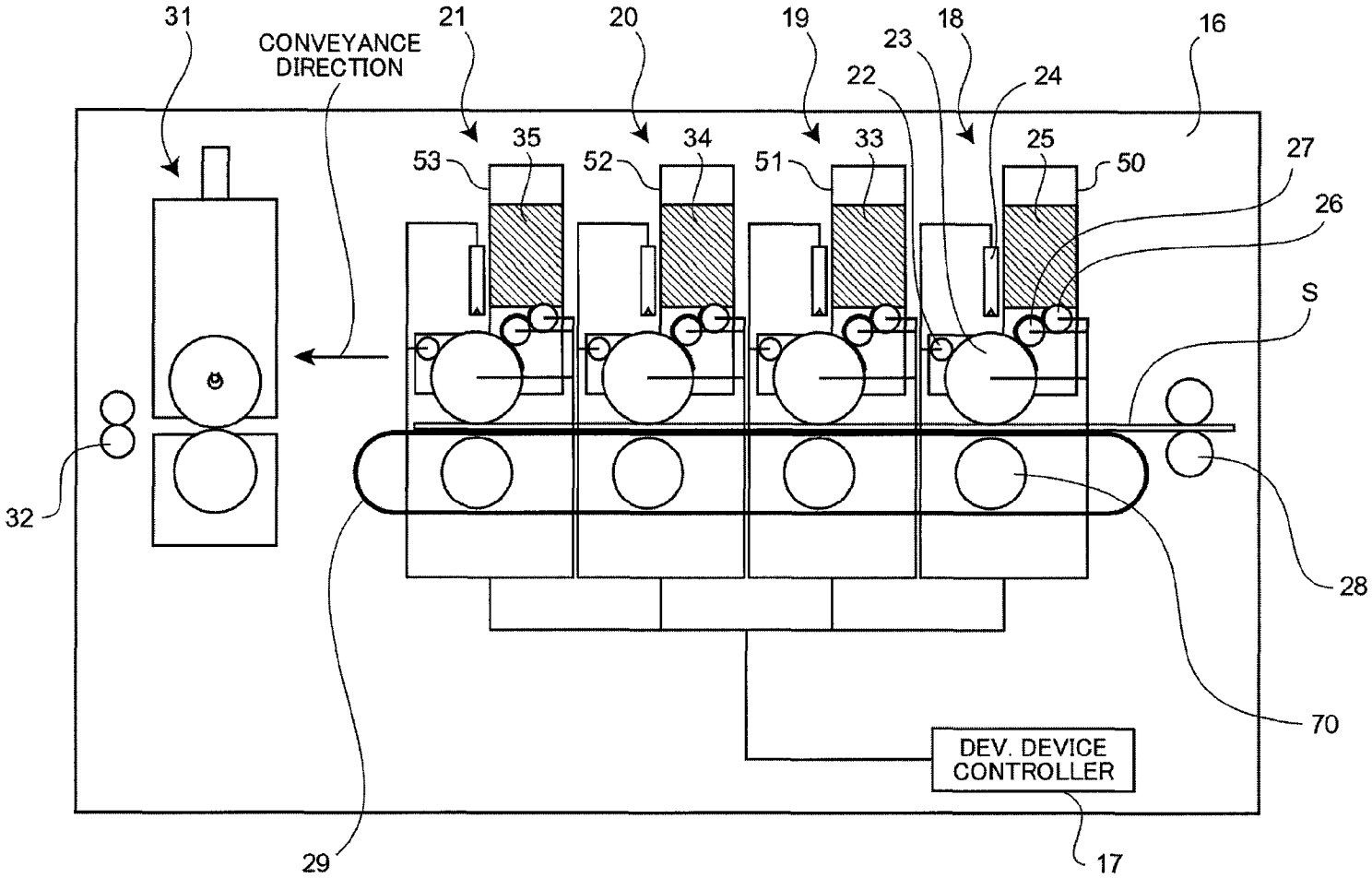
FIG. 5 is a schematic diagram illustrating a print unit.

As illustrated in FIG. 5, the Bk development unit 18 includes: a charging roller 22 charging a photosensitive drum 23; the photosensitive drum 23, charged by the charging roller 22, forming an electrostatic latent image thereon with a light irradiated by an exposure mechanism; a light emitting diode (LED) head 24, serving as the exposure mechanism, disposed opposite to the photosensitive drum 23 to irradiate a surface of the photosensitive drum 23 with the blink light corresponding to the print image; a black developer 25 including the black color of the toner according to the first embodiment of the present invention; a developer supply roller 26 conveying the Bk developer 25 stored in a developer container 50; and a development roller 27, disposed opposite to the photosensitive drum 23, developing the electrostatic latent image into a developer image by supplying the Bk developer 25 conveyed by the developer supply roller 26 to the photosensitive drum 23.

The yellow development unit 19, the magenta development unit 20, and the cyan development unit 21 include respective developer containers 51, 52, and 53 to contain a yellow developer 33, a magenta developer 34, and a cyan developer 35, respectively. According to the first embodiment, the black developer 25, serving as a first developer, is a black pigment serving as a carbon black having a property of absorbing near-infrared light. Each of the yellow developer 33, the magenta developer 34, and the cyan developer 35, serving as a second developer, is a color developer, and forms a layer on a developer layer of the first developer on the medium S. The yellow developer 33 can be a pigment made of isoindoline, quinophthalone and the like having a property of allowing the near-infrared light to permeate therethrough. The magenta developer 34 can be a pigment made of quinacridone, carmine, and the like having the property of allowing the near-infrared light to permeate therethrough. The cyan developer 35 can be made of copper phthalocyanine, anthraquinone, and the like having a property of allowing the near-infrared light to permeate therethrough.

The print unit 16 further includes: a pair of feed rollers 28 feeding the medium S from a medium supply unit (not shown); a transfer belt 29 conveying the medium S fed by the feed roller pair 28 to allow the developer images formed by the respective development units to be transferred to the medium S using transfer rollers 70 disposed opposite to the respective photosensitive drums of the respective development units; a fixing device 31 fixing the developer images transferred to the medium S with application of the heat and pressure; and a pair of ejection rollers 32 ejecting the medium S including the developer images fixed thereon by the fixing device 31 to outside the printer 1. The developer images formed by the respective development units are sequentially transferred to the medium S fed from the medium supply unit through the feed roller pair 28 while the medium S is being conveyed by the transfer belt 29. According to the first embodiment, the developer image serving as a first developer image formed by the black development unit 18 serving as the first development unit, and the developer images serving as second developer images formed by the yellow development unit 19, the magenta development unit 20, and the cyan development unit 21 serving as the second development units are sequentially transferred on the medium S from an upstream side to a downstream side in a conveyance direction of the medium S. After the developer images formed by the respective development units are transferred to the medium S, the fixing device 31 fixes the developer images on the medium S with application of the heat and pressure. The medium S including the developer image fixed thereon is ejected outside the printer 1 by the ejection roller pair 32.

A description is now given of the reading device 36. The reading device 36 includes a light emission unit (not shown) and a light reception unit (not shown). The reading device 36 allows the light reception unit to read a reflection light of a target object with respect to an irradiation light having a prescribed wavelength irradiated by the light emission unit, thereby reading a surface state of the target object, that is, reading a print content printed on the medium S according to the first embodiment. The reading device 36 can be formed in any shape as long as the reading device 36 is capable of emitting and receiving the light having the prescribed wavelength. The reading device 36, for example, can be formed in a pen shape to emit and receive the light or can be a flatbed scanner. The prescribed wavelength indicates the near-infrared light having the wavelength between 800 nm and 1000 nm according to the first embodiment of the present invention, and the near-infrared light is absorbed by the carbon black.

A description is now given of operation of the image forming system according to the first embodiment of the present invention.

When the user provides a print start instruction, the application 201 inside the host device 2 generates a spool file based on the color image prepared and the background design image, and outputs the generated spool data to the driver 202. Herein, the spool data serve as intermediate data of the print data to be passed to the driver 202 by the application 201.

When the spool file output from the application 201 is input, the PDL data generation unit 203 of the driver 202 generates the PDL data written in a program language for a drawing instruction with respect to the printer 1. Particularly, the PDL data generation unit 203 divides the color image of the RGB image into the red image data 3*b*, the green image data 3*c*, and the blue image data 3*d*, and generates the background design image data 3*a* from the background design image. The PDL data generation unit 203 generates the RGB print data 3 including the background design image data 3*a*, the red image data 3*b*, the green image data 3*c*, the blue image data 3*d*, and the print job data. Herein, the print job data are provided with the identifier identifying the RGB print data 3 having the background design image data 3*a*. Moreover, the print job data include instructions to form the images of the red image data 3*b*, the green image data 3*c*, and the blue image data 3*d* with the yellow developer 33, the magenta developer 34, the cyan developer 35, and to form the image of the background design image data 3*a* with the black developer 25.

The data transmission unit 204 transmits the RGB print data 3 generated by the PDL data generation unit 203 to the communication unit 4 of the printer 1.

Figure 6:
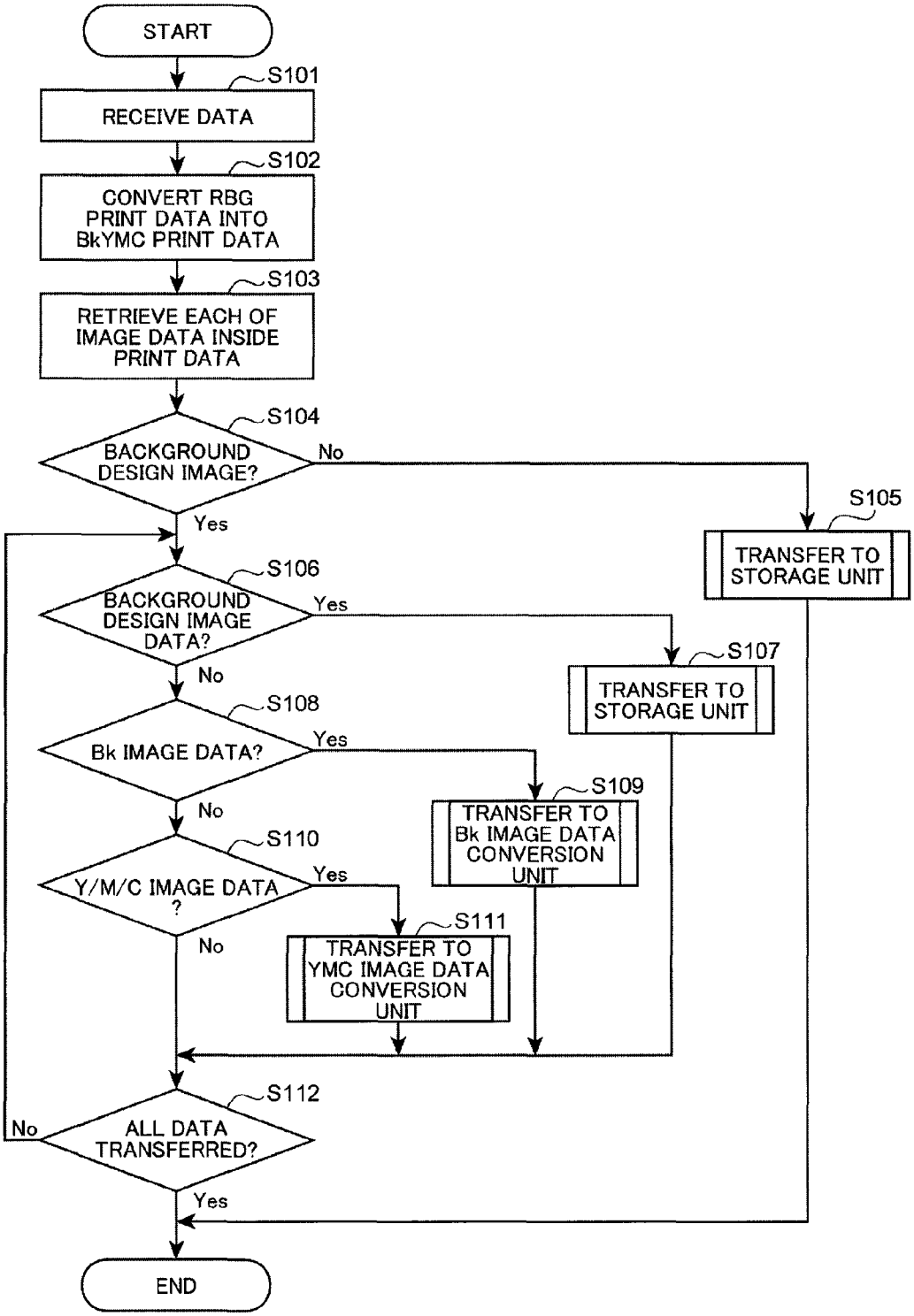
FIG. 6 is a flowchart illustrating an example operating procedure by a print data conversion unit and a print data analyzing unit.

Referring to a flowchart of FIG. 6, a description is given of an example procedure by the print data conversion unit 7 and the print data analyzing unit 8 disposed in the image data generation unit 6 of the printer 1.

The control unit 5 transfers the RGB print data 3 to the print data conversion unit 7 upon receiving the RGB print data 3 transmitted from the data transmission unit 204 of the host device 2 through the communication unit 4 (step S101).

The print data conversion unit 7 converts the red image data 3*b*, the green image data 3*c*, and the blue image data 3*d* of the transferred RGB print data 3 into the black image data 30Bk, the yellow image data 30Y, the magenta image data 30M, and the cyan image data 30C to form the BkYMC print data 30 as illustrated in FIG. 4 (step S102).

When the BkYMC print data 30 are formed by the print data conversion unit 7, the control unit 5 transfers the BkYMC print data 30 to the print data analyzing unit 8.

The print data analyzing unit 8 retrieves each of the image data inside the transferred BkYMC print data 30 (step S103), and determines whether or not the BkYMC print data 30 include the background design image data 3*a* based on the identifier included in the print job data (step S104).

Where the BkYMC print data 30 do not include the background design image data 3*a* therein (No in step S104), the print data analyzing unit 8 transfers the BkYMC print data 30 to the print data storage unit 9 (step S105).

Where the BkYMC print data 30 include the background design image data (Yes in step S104), on the other hand, the print data analyzing unit 8 performs the transfer process with respect to each of the background design image data 3*a*, the black image data 30Bk, the yellow image data 30Y, the magenta image data 30M, and the cyan image data 30C.

That is, where the retrieved image data are the background design image data 3*a* (Yes in step S106), the print data analyzing unit 8 transfers the background design image data 3*a* to the print data storage unit 9 (step S107).

Where the retrieved image data are not the background design image data 3*a* (No in step S106), and where the retrieved image data are the black image data 30Bk (Yes in step S108), the print data analyzing unit 8 transfers the black image data 30Bk to the Bk image data conversion unit 10 (step S109).

Where the retrieved image data are not the black image data 30Bk (No in step S108), and where the retrieved image data are any of the yellow image data 30Y, the magenta image data 30M, and the cyan image data 30C (Yes in step S110), the print data analyzing unit 8 transfers the corresponding yellow image data 30Y, the magenta image data 30M, or the cyan image data 30C to the YMC image data conversion unit 11 (step S111).

When the print data analyzing unit 8 transfers all of the BkYMC print data 30, a series of the transfer processes is finished (Yes in step S112).

Figure 7:
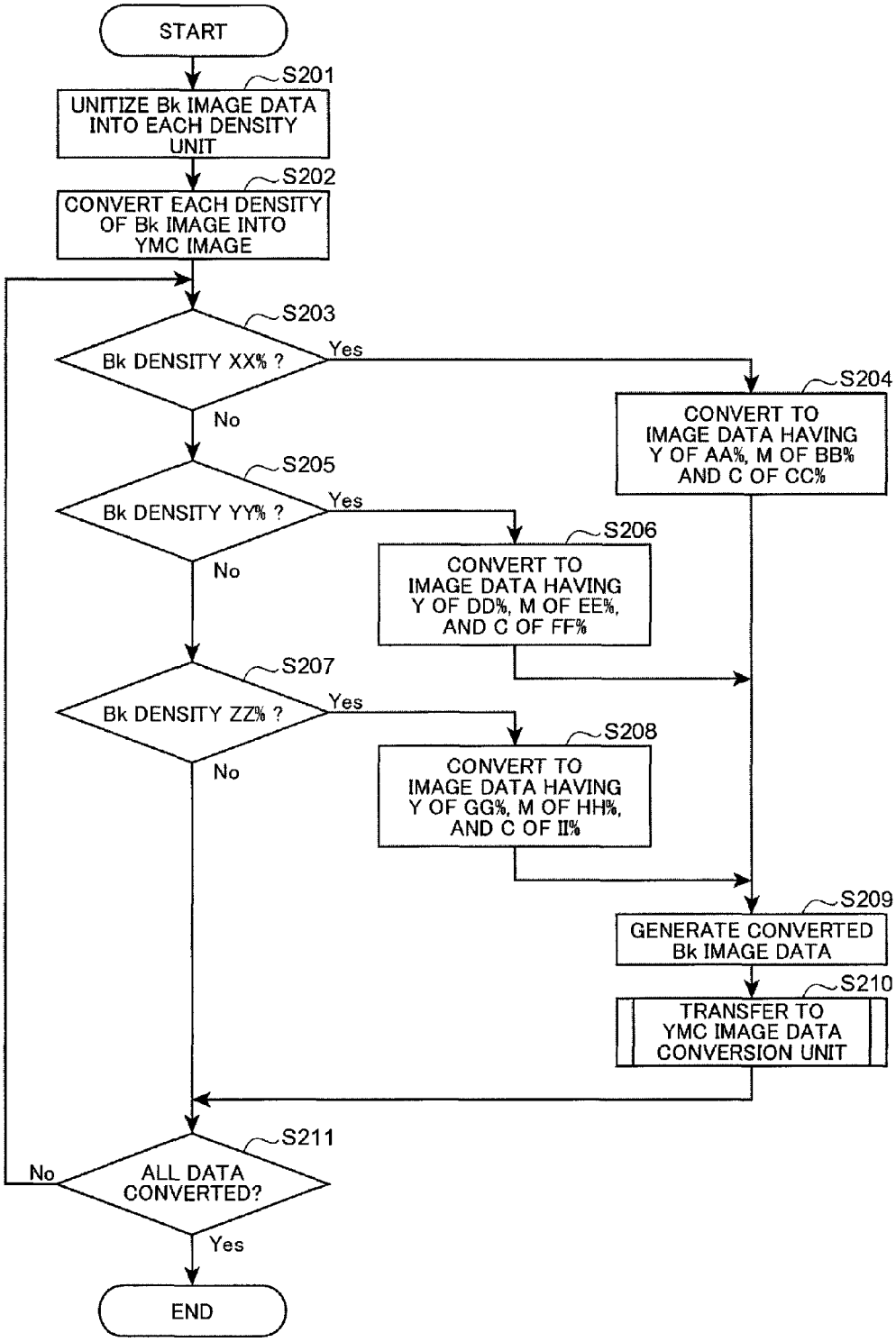
FIG. 7 is a flowchart illustrating an example color conversion procedure of Bk image data.

Referring to a flowchart of FIG. 7, a description is given of an example color conversion procedure of the black image data 30Bk by the Bk image data conversion unit 10.

The Bk image data conversion unit 10 unitizes the black image data 30Bk, transferred from the print data analyzing unit 8 in step S109 in the flowchart of FIG. 6, into units of the prescribed density, for example, Bk density of XX %, Bk density of YY %, and Bk density of ZZ % (step S201).

Subsequently, the Bk image data conversion unit 10 allows the black image data 30Bk to be allocated to each of the yellow, magenta, and cyan colors with respect to each of the unitized black density units (step S202).

Particularly, where the unitized Bk density is XX % (Yes in step S203), the Bk image data conversion unit 10 converts a unit having the Bk density of XX % into image data having the allocation rate with a Y image component of AA %, a M image component of BB %, and a C image component of CC % (step S204).

Where the unitized Bk density is YY % (Yes in step S205), the Bk image data conversion unit 10 converts a unit having the BK density of YY % into image data having the allocation rate with the Y image component of DD %, the M image component of EE %, and the C image component of FF % (step S204).

Where the unitized Bk density is ZZ % (Yes in step S207), the Bk image data conversion unit 10 converts a unit having the BK density of ZZ % into image data having the allocation rate with the Y image component of GG %, the M image component of HH %, and the C image component of II % (step S208).

Subsequently, the Bk image data conversion unit 10 integrates the image data converted in steps S204, 206, and 208 to generate the converted black image data 300Bk (step S209), and transfers the converted black image data 300Bk generated to the YMC image data conversion unit 11 (step S210).

When all of the unitized image data in the black image data 30Bk transferred from the print data analyzing unit 8 are converted, a series of the conversion processes by the Bk image data conversion unit 10 is finished (Yes in step S211).

Figure 8:
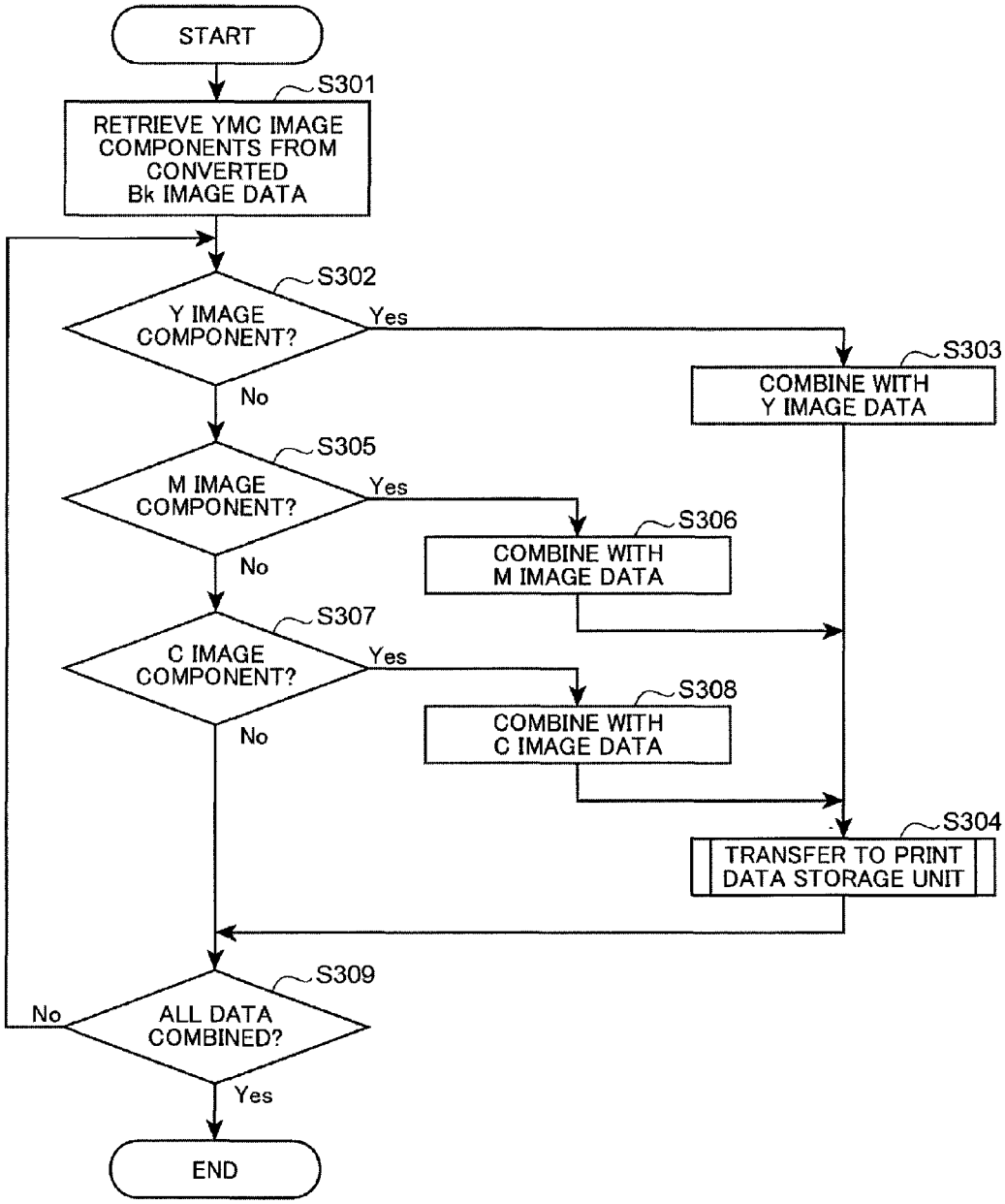
FIG. 8 is a flowchart illustrating an example procedure of combining converted Bk image data generated by a Bk image data conversion unit and Y image data, M image data, and C image data transferred from the print data analyzing unit.

Referring to a flowchart of FIG. 8, a description is given of a example procedure of combining the converted Bk image data 300Bk generated by the Bk image data conversion unit 10 and the yellow image data 30Y, the magenta image data 30M, and the cyan image data 30C transferred by the print data analyzing unit 8.

The YMC image data conversion unit 11 retrieves the Y, M, and C image components from the converted black image data 300Bk transferred, in step S210 in the flowchart of FIG. 7, from the Bk image data conversion unit 10 (step S301).

Where the image component retrieved in step S301 is the Y image component (Yes in step S302), the YMC image data conversion unit 11 combines the Y image component and the yellow image data 30Y transferred by the print data analyzing unit 8 to generate the converted yellow image data 300Y (steps S303), and transfers the converted yellow image data 300Y generated to the print data storage unit 9 (step S304).

Where the image component retrieved in step S301 is the M image component (Yes in step S305), the YMC image data conversion unit 11 combines the M image component and the magenta image data 30M transferred by the print data analyzing unit 8 to generate the converted magenta image data 300M (step S306), and transfers the converted magenta image data 300M generated to the print data storage unit 9 (step S304).

Where the image component retrieved in step S301 is the C component (Yes in step S307), the YMC image data conversion unit 11 combines the C image component and the cyan image data 30C transferred by the print data analyzing unit 8 to generate the converted cyan image data 300C (step S308), and transfers the converted cyan image data 300C generated to the print data storage unit 9 (step S304).

When all of the converted black image data 300Bk transferred from the Bk image data conversion unit 10 are converted, a series of the conversion processes by the YMC image data conversion unit 11 is finished (step S309).

Accordingly, the print image expressed in four colors using the black image data 30Bk, the yellow image data 30Y, the magenta image data 30M, and the cyan image data 30C is converted in such a manner as to be expressed in three colors of yellow, magenta, and cyan by the conversion and combining processes described above.

The control unit 5 instructs the development device control unit 17 to form the image according to each of the image data stored in the print data storage unit 9. Upon receiving the instruction, the development device control unit 17 controls each of the Bk, Y, M, and C development units 18, 19, 20, and 21 in such a manner that the Bk development unit 18 forms the background design pattern image 3A corresponding to the background design image data 3*a*, the Y development unit 19 forms the image corresponding to the converted yellow image data 300Y provided with image information of the black image data 30Bk, the M development unit 20 forms the image corresponding to the converted magenta image data 300M provided with the image information of the black image data 30Bk, and the C development unit 21 forms the image corresponding to the converted cyan image data 300C provided with the image information of the black image data 30Bk.

Now, a description is given of image forming operation by the printer 1 with reference to FIG. 5.

Upon receiving the print start instruction from the control unit 5, the development device control unit 17 controls a high voltage power source (not shown), so that the charging roller 22 disposed inside the Bk development unit 18 is applied with a negative voltage, thereby negatively charging the surface of the photosensitive drum 23. The development device control unit 17 controls the blink of the LED head 24, so that the surface of the photosensitive drum 23 is irradiated with the light based on the information of the background design image data 3*a*. The photosensitive drum 23 receives the light emitted from the LED head 24 while rotating, so that a charging amount of the negative electric charge is decreased in a portion receiving the light, that is, in a portion in which the background design pattern image 3A is to be formed, thereby forming the electrostatic latent image thereon.

The black development unit 18 includes the developer container 50 storing the black developer 25 therein. The black developer 25 is applied with the negative electric charge in the course of being conveyed to the photosensitive drum 23 by the developer supply roller 26 and the development roller 27. Accordingly, the black developer 25 is adhered only to the portion, on the surface of the photosensitive drum 23, in which the charging amount of the negative electric charge is decreased.

At the same time as the above operation, the control unit 5 provides the print start instructions to, for example, a feed and conveyance control unit (not shown), and a roller drive control unit (not shown), and allows the beginning of the conveyance of the medium S to the print unit 16.

When the medium S conveyed by the feed roller pair 28 reaches the black development unit 18, an electric field generated by a positive voltage applied from the high voltage power source (not shown) to the transfer roller 70 disposed to the transfer belt 29 allows the background design pattern image 3A formed with the black developer 25 to be transferred from the surface of the photosensitive drum 23 to the medium S using the transfer belt 29.

The development device control unit 17 continues to control the LED head 24 and the like based on the information of the converted yellow image data 300Y, the converted magenta image data 300M, and the converted cyan image data 300C, so that the development images are formed on the surfaces of respective photosensitive drums 23 by the yellow, magenta, and cyan development units 19, 20, and 21 with the respective yellow, magenta, and cyan developers 33, 34, and 35, and the development images are transferred to the surface of the medium S being conveyed by the transfer belt 29. Herein, each of the yellow developer 33, the magenta developer 34, and the cyan developer 35 includes the pigment having the property of allowing the near-infrared light to permeate therethrough as described above.

The medium S is conveyed by the transfer belt 29 in a direction indicated by an arrow shown in FIG. 5, and the fixing device 31 fixes the developer images on the medium S by application of the heat and pressure. The medium S including the developer images fixed thereon is ejected outside the printer 1 by the ejection roller pair 32, and the image forming operation is finished.

A description is now given of reading operation of the information of the color image print medium provided with the background design pattern image 3A. The background design pattern image 3A to be targeted in the first embodiment is the pattern image formed with the dots each of which has the size of approximately 50 μm to 100 μm as described above with reference to FIG. 3, and a detailed shape of the pattern may be difficult to be seen with the naked eyes.

The background design pattern image 3A includes the dot pattern having a mixture of linearly arranged dots and randomly arranged dots as illustrated in a left portion of FIG. 3. A positional relationship among the randomly arranged dots is analyzed by a prescribed algorism, so that the information provided beforehand can be uniquely read. The linearly arranged dots are connected with a chain line in FIG. 3 for the sake of explanation. However, the image except the dots is not printed on the medium S in a practical sense.

Herein, since the black developer 25 includes the carbon black serving as the pigment capable of absorbing the light having the prescribed wavelength light, the black developer 25 has the property of absorbing the near-infrared light according to the first embodiment.

Figure 9:
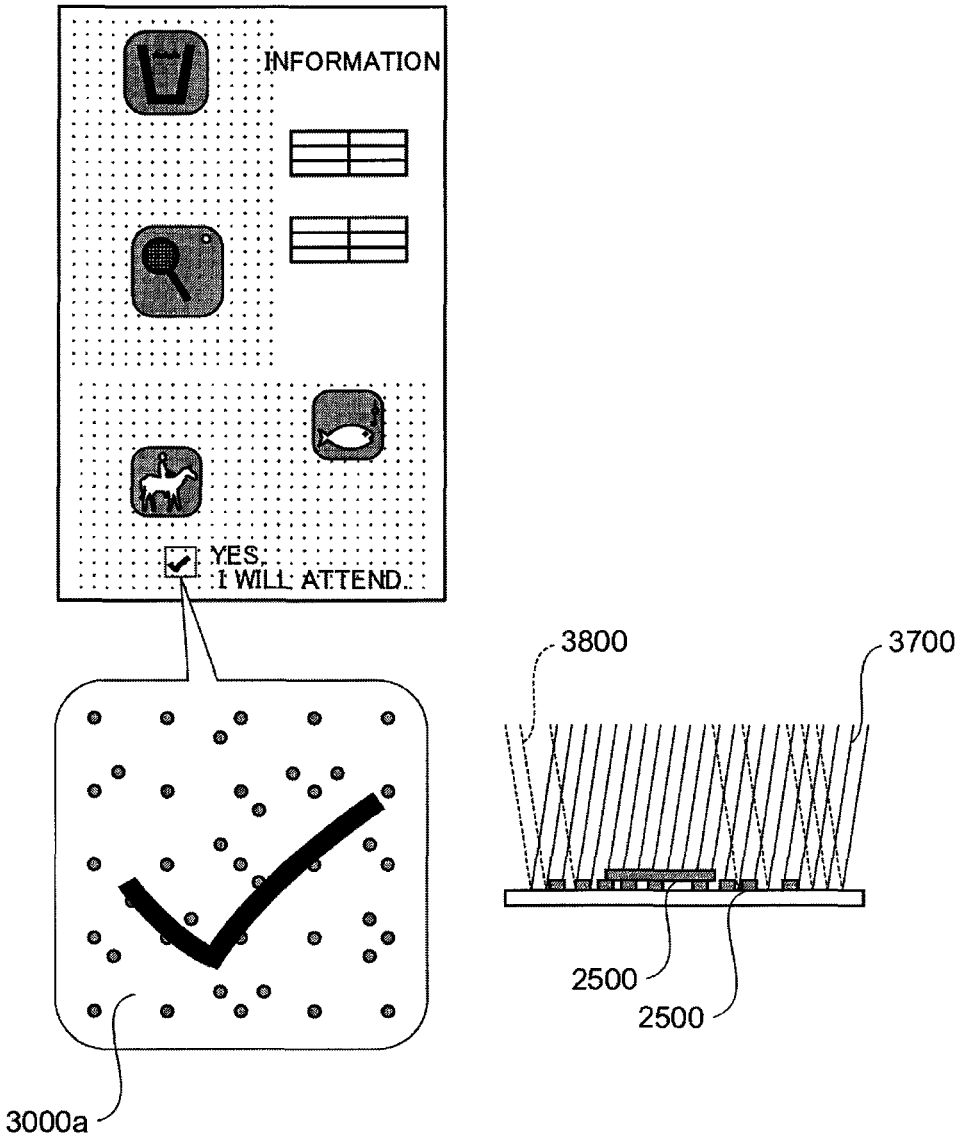
FIG. 9 PRIOR ART
FIG. 9 is a schematic diagram illustrating a printing result of an image expressed by Bk image data with a Bk developer and a reading result thereof according to a prior art method.
Figure 10:
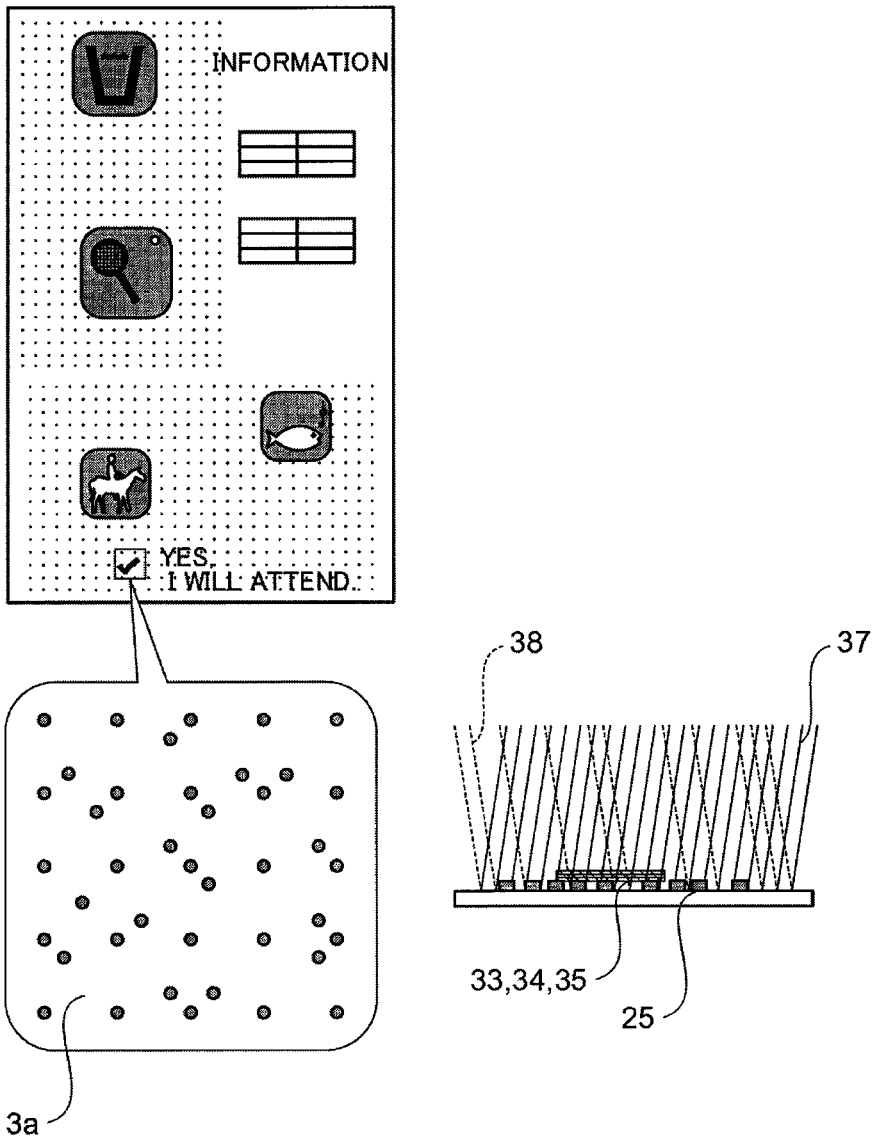
FIG. 10 is a schematic diagram illustrating a printing result of an image expressed by the Bk image data with a Bk developer and a reading result thereof according to the first embodiment of the present invention.

Referring to FIG. 9, a description is given of a printing result of an image expressed by Bk image data with a Bk developer 2500 and a reading result thereof according to a prior art method. Referring to FIG. 10, a description is given of a printing result of the image expressed by the Bk image data 30Bk with the yellow developer 33, the magenta developer 34, and the cyan developer 35 and a reading result thereof according to the first embodiment.

In the print image formed by the prior art method as illustrated in FIG. 9, a background design pattern image 3000A based on a background design image data 3000*a* and a check mark portion are formed with a developer 2500. In a case where such an image is read by a reading device using the near-infrared light having a wavelength of 800 nm to 1000 nm as a light source, the check mark portion is read as a reading image due to reduction of a reflection light 3800 from a medium caused by absorption of an irradiation light 3700 having the wavelength of 800 nm to 1000 nm to the black developer 2500 forming the background design pattern image 3000A and the check mark portion.

In the print image formed by the method according to the first embodiment as illustrated in FIG. 10, on the other hand, a check mark portion or an illustration image portion is formed with the Y developer 33, the M developer 34, and the C developer 35. Accordingly, an irradiation light 37 having a wavelength of 800 nm to 1000 nm emitted from the reading device 36 permeates the check mark portion or the illustration image portion, thereby not reading the check mark portion or the illustration image portion as the reading image. Therefore, the background design pattern image 3A formed with the Bk developer 25 on a lower layer can be correctly read.

A description is now given of an example case where homepage address information on tennis courts on the Internet is provided on the background design pattern image 3A on a lower layer of a racket image portion on the printed image of FIG. 10. In a case where the reading device 36 connected to the personal computer or the like reads the racket image portion of the print image printed according to the first embodiment, the printed address information on the tennis courts can be read as the background design pattern image 3A on the lower layer of the racket image portion. The homepage information on the tennis courts, that is, an overview of the tennis courts, can be displayed on a display device, such as a monitor, connected to the personal computer through a browser or the like based on the address information read by the reading device 36. For example, in a case where the user allows the reading device 36 to read the check mark portion receiving an input of the user's intention of attendance at the tennis on the print image, additional information such as a reservation screen and a price list can be displayed.

According to the first embodiment, the background design pattern image 3A is formed with the Bk developer 25 including the carbon black as the black pigment, and the reading device 36 emitting the near-infrared light having the wavelength of 800 nm to 1000 nm as the light source is used to obtain the information provided to the background design pattern image 3A. However, the present invention is not limited thereto. For example, the background design pattern image 3A can be formed with a developer in which a primary component is a pigment having a property of absorbing a light having the prescribed wavelength, and information provided to the background design pattern image 3A can be read by a reading device such as a specific scanner or a camera using the light having the wavelength to be absorbed by the developer as a light source. That is, as long as the wavelength of the light can specify an image to be formed by a target color, any light having the prescribed wavelength can be used in addition to the near-infrared light.

According to the first embodiment, the description has been given of the color printer capable of forming the print image with the developers of four colors such as black, yellow, magenta, and cyan as an example case. However, the color of the developer, the type of the pigment and the like are not limited thereto. For example, other colors including red, blue, green, and neutral color developers can be used.

According to the first embodiment described above, therefore, in a case where the background design image data and the print data including the black image are printed inside the color image data except the background design image data, the black image except the background design image data is formed using the other developers. Accordingly, the background design pattern image formed on the lower layer of the image can be read at a visible light, so that the print restriction can be removed with respect to the print data serving as the readable image in a printable region of the background design image data.

Second Embodiment

Figure 11:
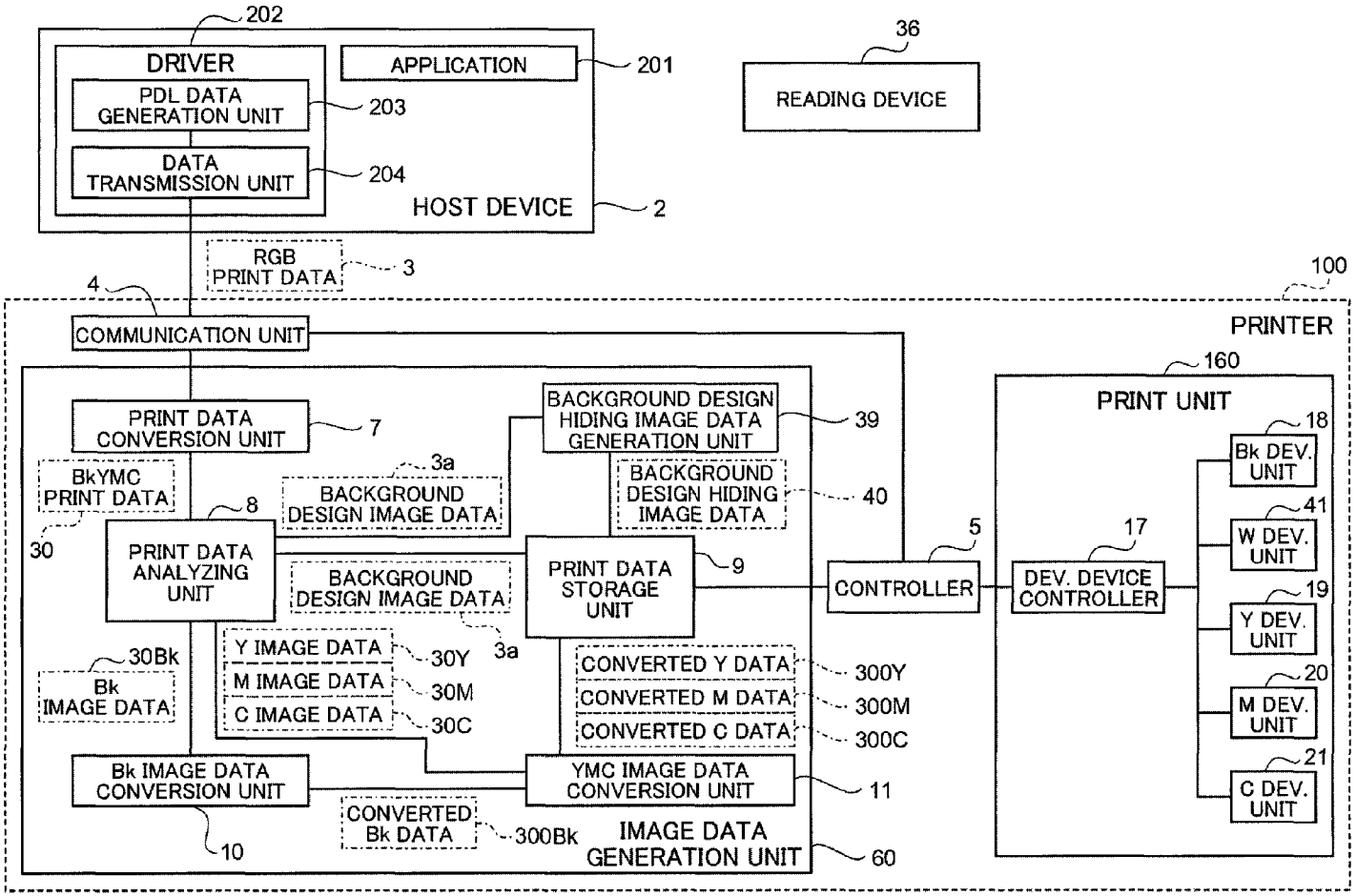
FIG. 11 is a schematic block diagram illustrating an image forming system according to a second embodiment of the present invention.

Referring to FIG. 11, an image forming system according to a second embodiment is illustrated in a block diagram. The image forming system of the second embodiment is substantially similar to that of the first embodiment except for a printer 100. Only components and configurations differ from those of the above embodiment will be described, and like components will be given the same reference numerals as above while description thereof will be omitted.

The printer 100 includes a communication unit 4, a control unit 5, an image data generation unit 60, and a print unit 160. The description is now given of the image data generation unit 60, followed by the description of the printer 160.

The image data generation unit 60 includes a background design hiding image data generation unit 39 in addition to the structure of the image data generation unit 6 of the first embodiment. The background design hiding image data generation unit 39 generates background design hiding image data 40 with respect to a background design image data 3*a*. Herein, the background design hiding image data 40 serve as data for a solid print image (hereafter referred to as a background design hiding image) having a size slightly bigger than a contour size of a background design pattern image 3A expressed by the background design image data 3*a*. The background design hiding image data 40 are print data corresponding to the background design image data 3*a*, and a background design hiding image 40A is formed in the same position as the background design image data 3*a* with a different developer.

The print unit 160 is now described with reference to FIGS. 11 and 12. The print unit 160 includes a W development unit 41 in addition to the structure of the print unit 16 of the first embodiment. The W development unit 41 forms the background design hiding image 40A for a hiding of the background design pattern image 3A formed in a Bk development unit 18 and transferred to a medium S. According to the second embodiment, the medium S is described as a sheet such as a printing sheet. However, the medium S is not limited to thereto. For example, the medium S may be an intermediate transfer belt.

The W development unit 41, serving as a development unit, forms the background design hiding image 40A with a W developer 42 to hide the background design pattern image 3A which may be seen as a print stain on a background of the print image. Accordingly, when the background design pattern image 3A and the print image are transferred to the medium S, the W development unit 41 needs to form a developer layer serving as a second developer layer formed not only on the side of an upper layer relative to the developer layer of the background design pattern image 3A, but also on the side of a lower layer relative to a developer layer of a yellow developer 33, a magenta developer 34, and a cyan developer 35 serving as second developers forming the print image. In the printer 100 according to the second embodiment, therefore, the W development unit 41 is positioned on the side of downstream relative to the Bk development unit 18 and on the side of upstream relative to a Y development unit 19, a M development unit 20, and a C development unit 21 in a medium conveyance direction in which the medium S is conveyed by a transfer belt 29 as illustrated by an arrow shown in FIG. 12.

The W development unit 41 forms the developer layer to hide the background design pattern image 3A to be transferred to the lower layer in the course of printing. Therefore, the developer image formed by the W development unit 41 is applied with the heat and pressure in a fixing device 31 to reduce relief occurrences of the background design pattern image 3A. Accordingly, the second embodiment employs a method for forming a developer layer thicker than a developer layer formed for a general print image. In a case where the developer layer becomes thicker than necessary, the developer is not adequately heated or melted in the course of fixing operation in the fixing device 31, causing the possibility of insufficient fixing, that is, offset. Consequently, the thickness of the developer layer is preferably arranged to be a certain value obtained by an experiment and the like beforehand. Particularly, the thickness of the developer layer is adjusted in such a manner as to be 0.02 mm according to the second embodiment while the thickness of the developer layer formed on the general print image is 0.01 mm. The developer layer thickness can be optimized by, for example, adjusting a development voltage applied to a development roller 27, and a shape or a position of a regulation member (not shown) regulating the thickness of the developer layer on a development roller 28. That is, an amount of the W developer 42 to be supplied from a photosensitive drum 23 to the development roller 27 is adjusted, thereby optimizing the thickness of the developer layer. Herein, the W development unit 41 is structured substantially similar to each of the Bk development unit 18, the Y development unit 19, the M development unit 20, and the C development unit 21 described above in the first embodiment. However, the regulation member and the like may be changed as necessary to adjust the supply amount of the developer.

A description is now given of operation of the image forming system according to the second embodiment of the present invention. In the printer 100 according to the second embodiment, a print data conversion unit 7 generates BkYMC print data 30 from RGB print data 3 and transfers the RGB print data generated to a print data analyzing unit 8 as similar to the first embodiment.

According to the second embodiment, for example, where the print data analyzing unit 8 determines that the BkYMC print data 30 include the background design image data 3*a*, a copy of the background design image data 3*a* is transferred to the background design hiding image data generation unit 39.

Subsequently, the background design hiding image data generation unit 39 newly generates the background design hiding image data 40 corresponding to the background design image data 3*a* based on the copy of the background design image data 3*a* transferred from the print data analyzing unit 8, and allows the background design hiding image data 40 generated to be stored in a print data storage unit 9.

Figure 12:
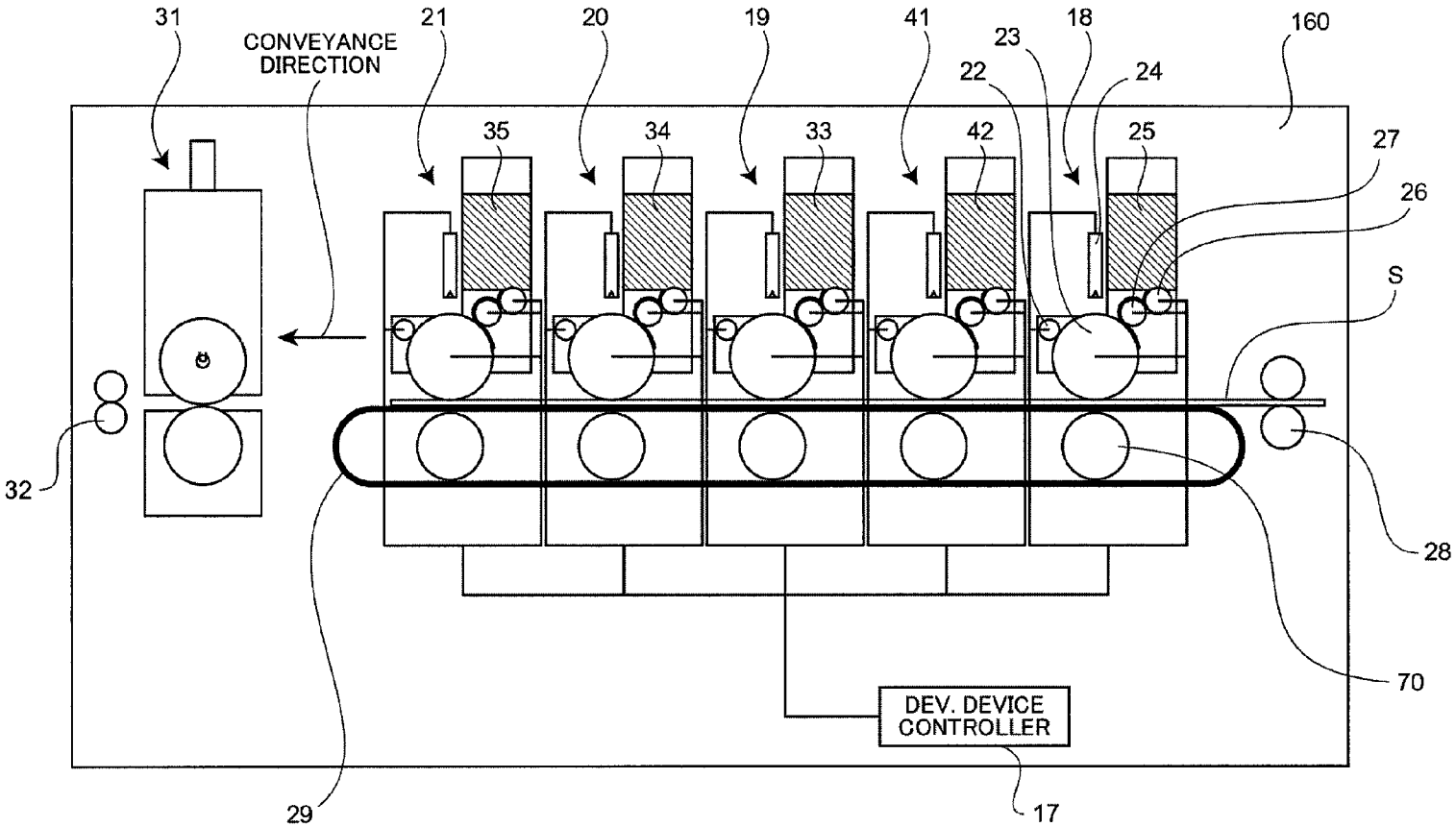
FIG. 12 is a schematic diagram illustrating a print unit in the image forming system of FIG. 11.

Referring to FIG. 12, the image forming operation of the printer 160 is described.

A development device control unit 17 allows the background design pattern image 3A formed with a Bk developer 25 to be transferred from the surface of the photosensitive drum 23 to the medium S when the generation of the background design image data 3*a*, the converted yellow image data 300Y provided with image information of black image data 30Bk, the converted magenta image data 300M provided with the image information of the black image data 30Bk, and the converted cyan image data 300C provided with the image information of the black image data 30Bk is completed.

Subsequently, the development device control unit 17 provides an instruction with respect to the W development unit 41 to form the background design hiding image 40A to be expressed by the background design hiding image data 40 with the W developer 42. Upon receiving the instruction, the W development unit 41 forms the background design hiding image 40A on the entire surface of the background design pattern image 3A with the developer 42 in such a manner as to cover the background design pattern image 3A already transferred to the medium S. That is, the W development unit 41 determines a printable region of the background design pattern image 3A based on the image information of the background design image data 3*a* to form the background design hiding image 40A.

Herein, the W developer 42 for formation of the background design hiding image 3A according to the second embodiment includes a pigment made of a known titanium dioxide compound having a high permeability of the infrared ray, that is, a pigment made of a component allowing the light having a prescribed wavelength to permeate therethrough as similar to the first embodiment described above. Accordingly, even in a case where the background design pattern image 3A is read subsequent to the print completion by a reading device 36 using the near-infrared light having the wavelength of 800 nm to 1000 nm as a light source, the background design pattern image 3A can be read correctly since the W developer 42 has a property of permeating the near-infrared light therethrough.

The background design hiding image 40A is formed with the W developer 42 on an upper layer of the background design pattern image 3A, causing the difficulty of visually recognizing the background design pattern image 3A. That is, the second embodiment allows the background design pattern image 3A, printed in the vicinity of the print image, having the possibility of being seen as a stain with respect to the print image to be hidden. Therefore, an image to be formed on the background design hiding image 40A with the W developer 42 can be printed while maintaining the fineness thereof.

The development device control unit 17 controls the Y development unit 19, the M development unit 20, and the C development unit 21, so that the developer images with respect to the respective colors formed by respective development units are sequentially transferred to the medium S.

The medium S conveyed by the transfer belt 29 in the conveyance direction as indicated by the arrow shown in FIG. 12 is applied with the heat and pressure by the fixing device 31, thereby fixing the developer images thereon. The medium S including the developer images fixed thereon is ejected outside the printer 100 by a pair of ejection rollers 32, and the image forming operation is finished.

Figure 13:
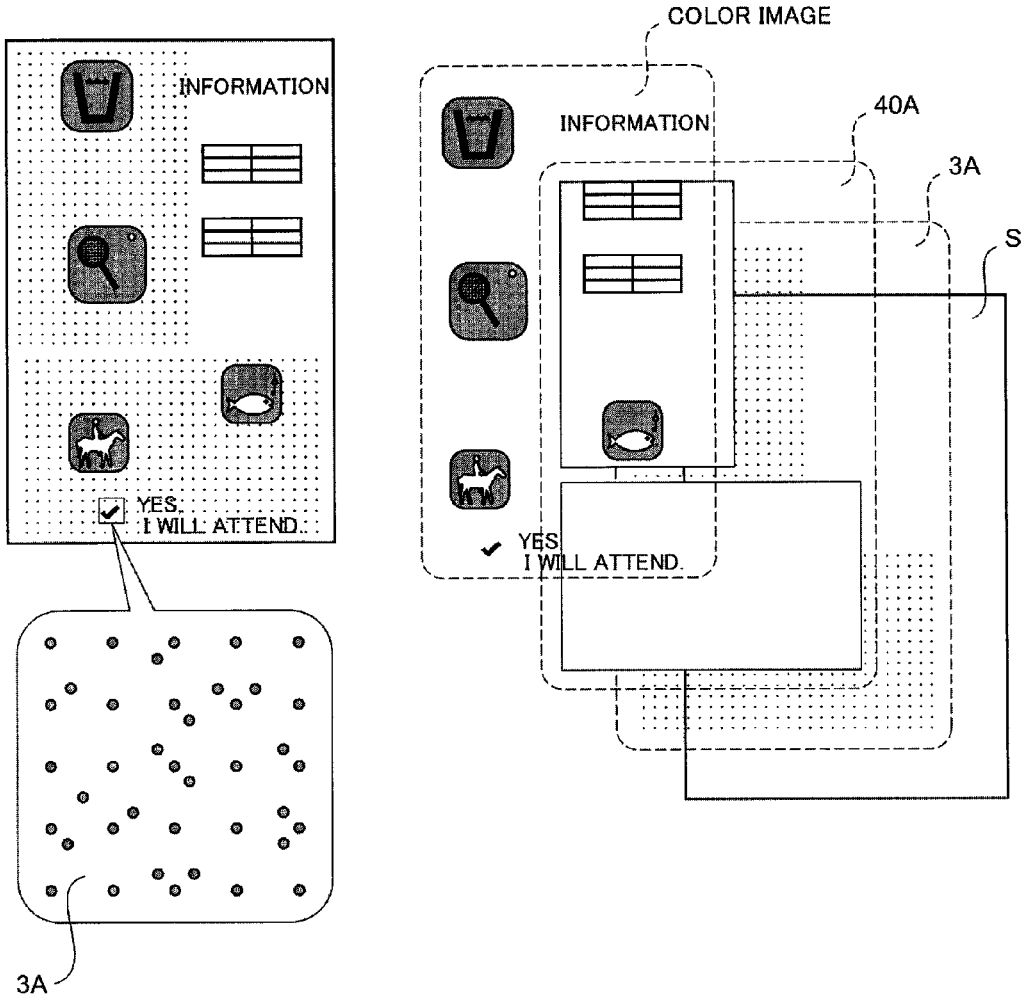
FIG. 13 is a schematic diagram illustrating a printing result of a background design hiding image expressed by background design hiding image data with W developer and an image expressed by a BK image with Y developer, M developer, and C developer, and a reading result thereof.

Referring to FIG. 13, a description is given of a printing result of the image expressed by the Bk image data 30Bk with the yellow developer 33, the magenta developer 34, and the cyan developer 35 and a reading result thereof according to the second embodiment as similar to the first embodiment.

In the visible light as illustrated in FIG. 13, the background design pattern image 3A is hidden by the background design hiding image 40A expressed by the background design hiding image data 40 with the W developer 42, and a check mark formed with the Y developer 33, the M developer 34, and the C developer 35 is not read while the background design pattern image 3A formed with the Bk developer 25 on a lower layer can be correctly read.

The second embodiment of the present invention has been described above. However, the second embodiment may be modified as follows:

Modification 1

The W developer 42 is preferably an opaque white color or pale color in the visible light. However, in a case where a pale color pigment except the white color is used, the color tone can be adjusted by reducing a blending amount of the pigment to maintain the fineness of the color image. In a case where the hiding property of the background design pattern image 3A with respect to the print image or the deterioration of the fineness of the color image is not considered, a transparent developer can be used in the visible light instead of the above developer. According to the second embodiment, for example, the titanium dioxide compound having the high permeability of the infrared ray is used as the W developer 42. However, in a case where a color capable of easily hiding the background design pattern image 3A in an inconspicuous manner is selected, a pigment made of isoindoline, used for the Y developer, can be used.

Modification 2

According to the second embodiment, the background design hiding image 40A expressed by the background design hiding image data 40 is formed in the region corresponding to the background design pattern image 3A expressed by the background design image data 3*a*. However, the background design hiding image data 40 can be formed with respect to each of small regions covering each of the respective dots forming the background design pattern image 3A, thereby reducing the amount of the W developer 42 to be consumed.

In a case where the background design hiding image data 40 is formed in such a manner as to cover a larger region relative to the background design pattern image 3A, on the other hand, the background design pattern image 3A can be surely covered, thereby tolerating a small misregistration of the print position of the background design hiding image 40A with respect to the background design pattern image 3A. Moreover, since a background color with respect to the print image is stabilized, the quality of the print image can be enhanced.

Modification 3

The background design hiding image 40A expressed by the background design hiding image data 40 can be formed in such a manner as to cover the entire surface of the medium S, so that the developer layer of the W developer 42 can be constantly formed with respect to the medium S, thereby supplying the W developer 42 to the entire surface of the photosensitive drum 23 of the W development unit 41 and transferring the W developer 42 from the photosensitive drum 23 to the medium S. Accordingly, the generation of the image data corresponding to the background design pattern image 3A and the formation of an electrostatic latent image by the LED head 24 of the W development unit 41 can become unnecessary.

Modification 4

In a case where a specific medium is used, for example, a background color of the medium and a print color of the background design hiding image 40A expressed by the background design hiding image data 40 can be arranged close to each other, thereby reducing occurrences of a color difference between the background color of the medium and the color of the background design hiding image 40A. That is, the color of the developer for formation of the background design hiding image 40A and the background color of the medium can be arranged in the same tone color, thereby allowing the background design hiding image 40A to be inconspicuous. Moreover, a possible influence on the background design hiding image 40A in case of using the white color as the W developer 42 can be reduced. That is, the influence exerted on the color of the print image caused by the presence or absence of the white color as the W developer 42 on the base of the print image can be reduced.

Modification 5

According to the second embodiment, the W development unit 41 is disposed to perform the multi-color printing while using the W developer 42. However, in a case where the printing is performed with a specific color, for example, a monochrome printing, an additional development unit does not need to be disposed in the printer 100. For example, the Bk development unit 18 for the printing of the background design pattern image 3A and the W development unit 41 for the printing of the background design hiding image 40A can be disposed in the conveyance direction of the transfer belt 29. Herein, the W development unit 41 can be disposed to the Y development unit 19 disposed on the downstream side of the Bk development unit 18 in the conveyance direction of the transfer belt 29. The M development unit 20 can serve as, for example, a compose Bk development unit forming a developer image with a composite black developer made of the Y, M, and C developers mixed beforehand without using the carbon black for the printing of the print image in black. Accordingly, the printer 100 can perform the second embodiment without the additional development unit.

Modification 6

Figure 14:
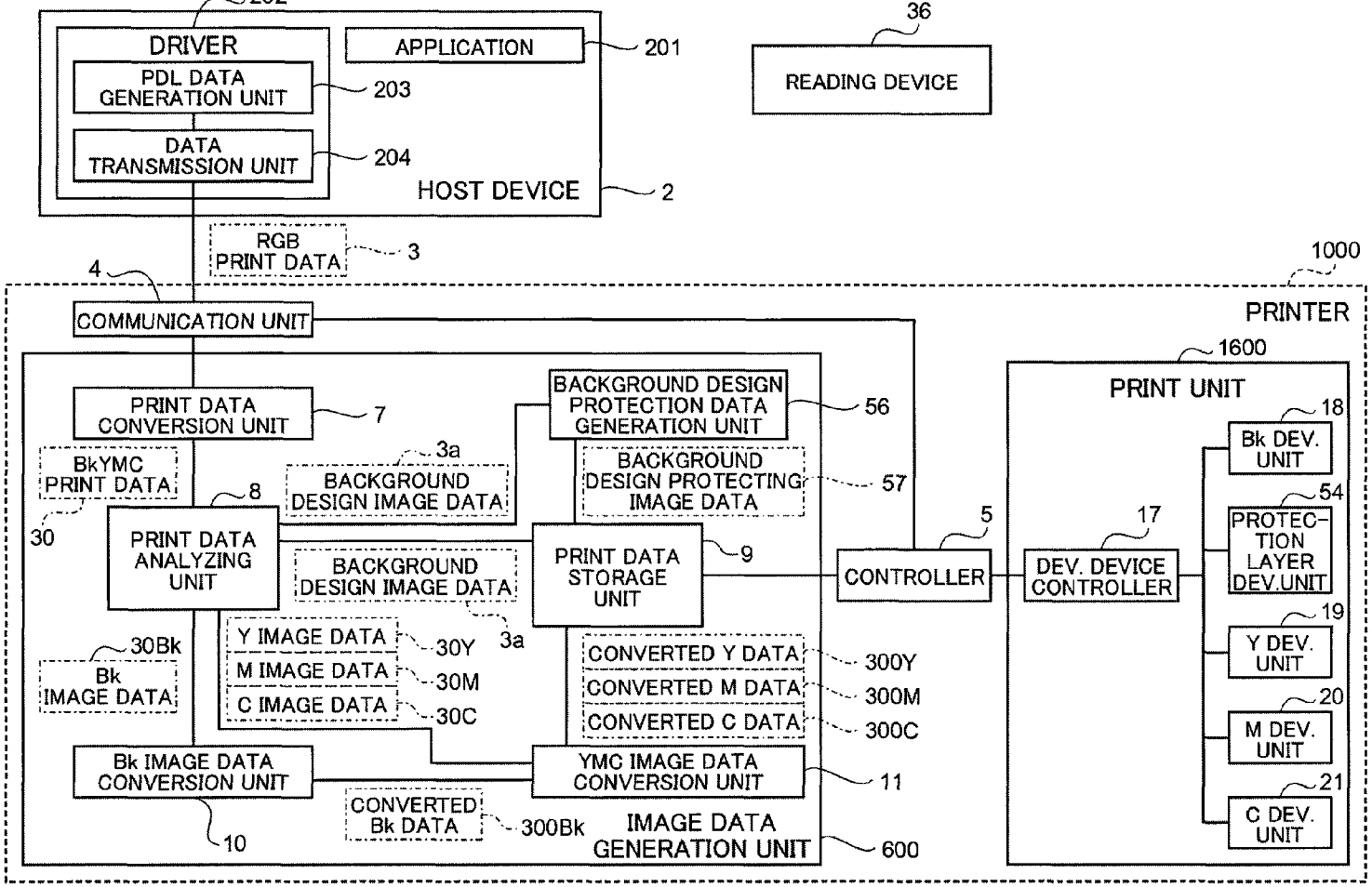
FIG. 14 is a schematic block diagram illustrating an image forming system according to a modification of the second embodiment.
Figure 15:
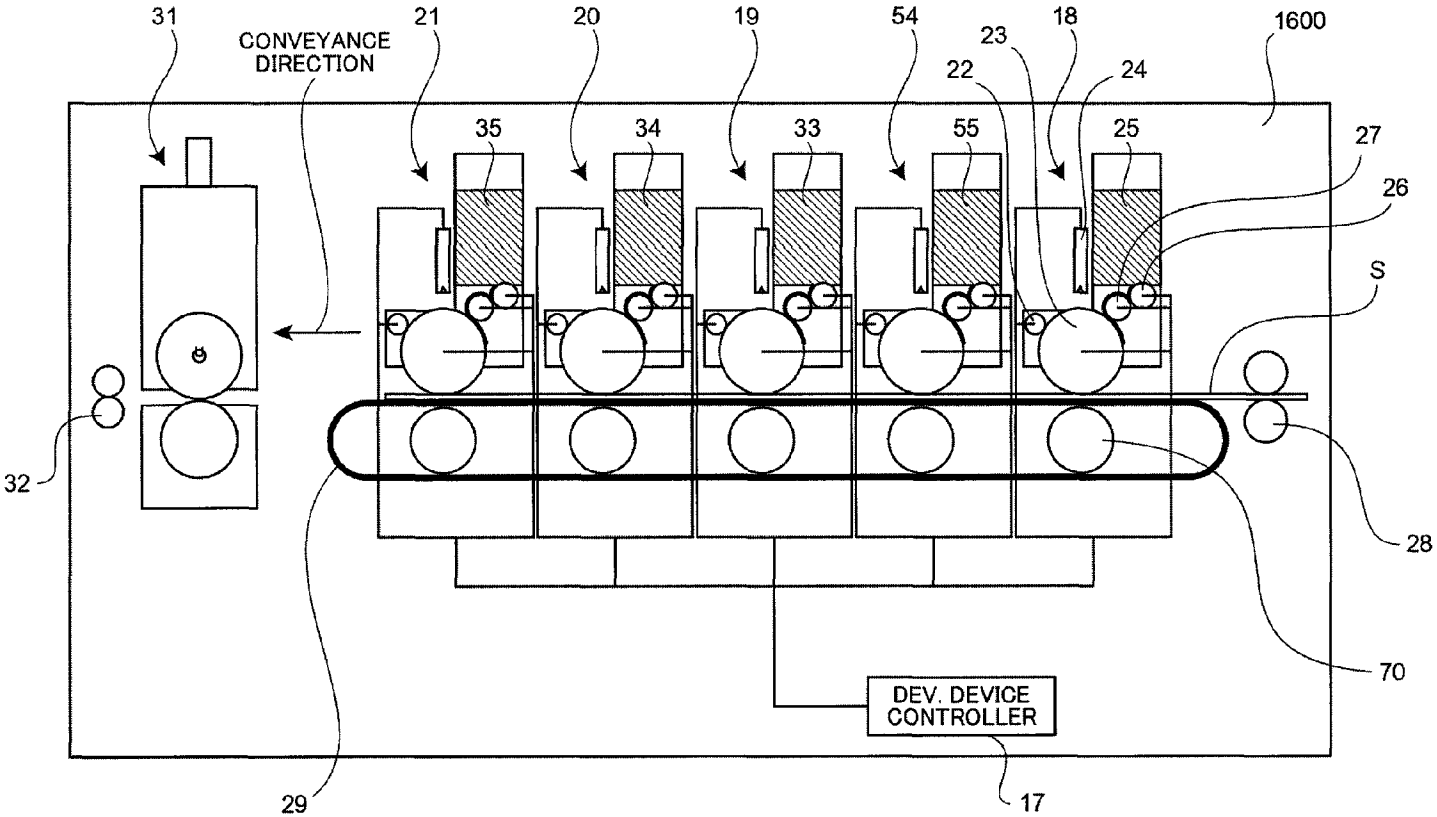
FIG. 15 is a schematic diagram illustrating a print unit in the image forming system of FIG. 14.
Figure 16:
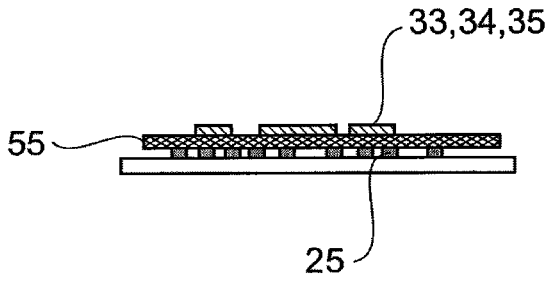
FIG. 16 is a schematic cross-sectional view illustrating a developer layer formed on a medium.

A modification 6 is described with reference to a block diagram of FIG. 14 illustrating an image forming system and a schematic diagram of FIG. 16 illustrating a print unit 1600 of a printer 1000.

The W development unit 41 of the second embodiment can be modified as a protection layer development unit 54 forming a protection layer for background design protection with a protection developer 55, thereby forming the protection layer on the background design pattern image 3A with the protection developer 55 in the modification 6. The protective developer 55 may be the W developer 42. However, in a case where the print image quality is not considered, a transparent developer can be used.

A background design protection data generation unit 56 is disposed as illustrated in FIG. 14 instead of the background design hiding image data generation unit 39 of the second embodiment as illustrated in FIG. 12, thereby allowing background design protecting image data 57 to be stored in a print data storage unit 9. The background design protecting image data 57 can be used to form an image as similar to the background design hiding image data 40. According to the modification 6 of the second embodiment, however, since an object of the background design protecting image data 57 is formation of the protection layer protecting the background design pattern image 3A, a background protection image 57A expressed by the background design protecting image data 57 is preferably an image covering a region slightly larger than the background design pattern image 3A.

A description is now given of image forming operation of the printer 1000.

The development unit 17 allows the protection layer development unit 54 to form the background design protection image 57A, corresponding to the background design pattern image 3A developed by the Bk development unit 18, with the protection developer 55 with respect to the medium S to be conveyed. The development device control unit 17 controls to transfer the developer images formed by the respective Y development unit 19, M development unit 20, and C development unit 21 to the surface of the medium S.

Accordingly, the developer layer is formed as illustrated in FIG. 16. The developer layer formed on the medium S as an example developer layer is illustrated in a cross-sectional view of FIG. 16. The background design protection image 57A is formed with the protection developer 55 in such a manner as to cover the background design pattern image 3A formed with the Bk developer 25, so that a reverse transfer can be reduced (if not prevented). The reverse transfer is a phenomenon transferring a portion of the Bk developer 25 of the background design pattern image 3A to any of the Y, M, and C development units 19, 20, and 21 when the developer images are transferred by the respective Y, M, and C development units 19, 20, and 21. According to the modification 6 of the second embodiment, therefore, a good background design pattern image can be provided on the medium S. Since the background design pattern image 3A expressed by the dots is not deteriorated by the reverse transfer, the background design pattern image 3A can be surely read by the reading device 36.

According to the second embodiment including the modifications, therefore, the background design hiding image is formed on the upper layer of the background design pattern image, so that no only the background design pattern image formed with the Bk developer is hidden, but also the color tone or fineness of the color image is not damaged in addition to the advantages of the first embodiment. Moreover, the background design pattern image serves as the background of the color image, thereby enhancing the quality of the print image. Moreover, the second embodiment including the modifications can reduce (if not prevent) the deterioration of the background design pattern image caused by the reverse transfer of the portion of the developer forming the background design pattern image to the surface of the photosensitive drum in the color development unit disposed in a downstream relative to the medium conveyance direction after the background design pattern image is transferred to the medium.

Third Embodiment

Figure 17:
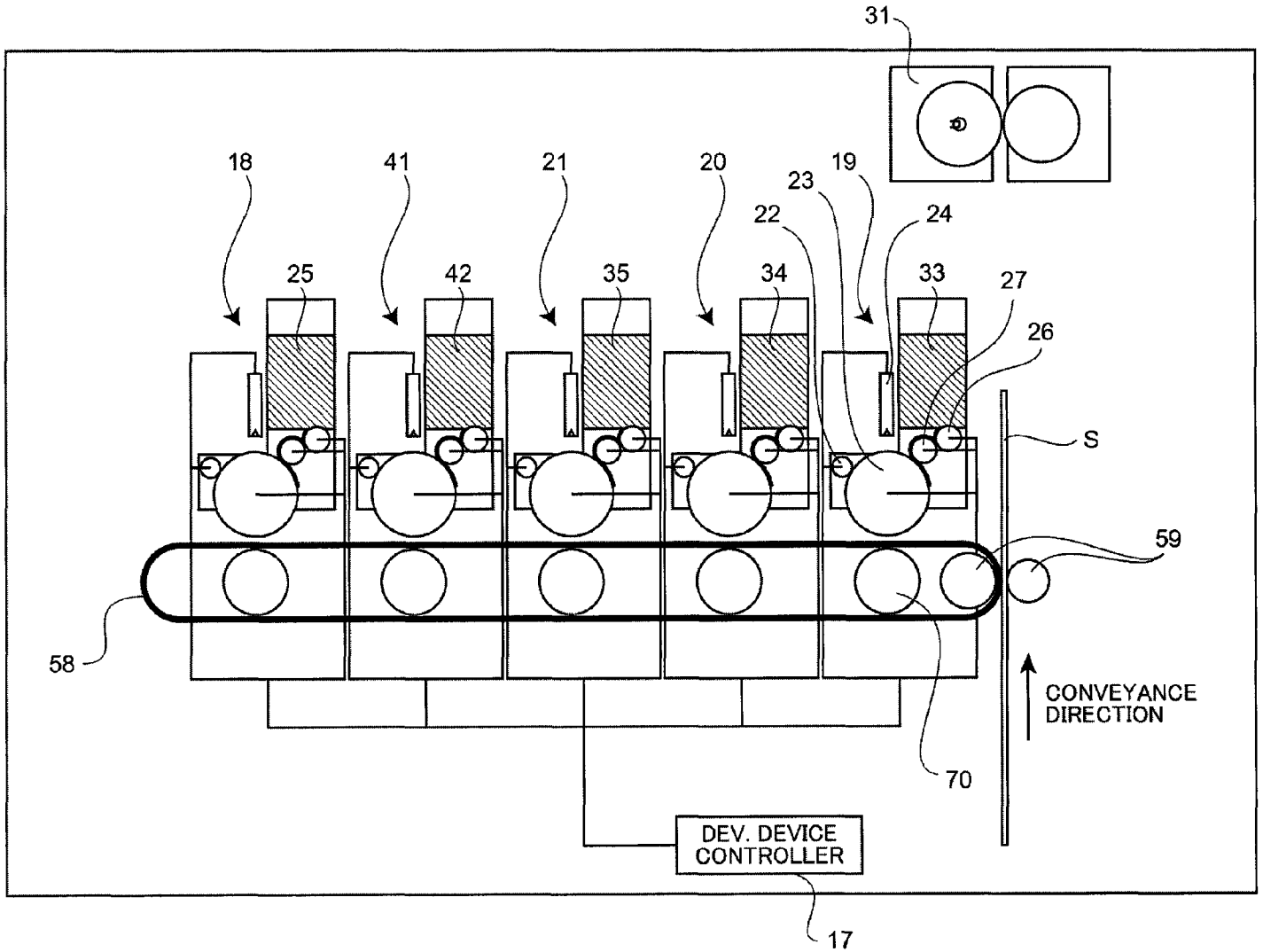
FIG. 17 is a schematic diagram illustrating a print unit according to a third embodiment of the present invention.

According to the first and second embodiments above, the printer employing a direct transfer method directly transferring the developer image formed by each of the development units to the medium being conveyed has been described as an example. A third embodiment of the present invention, on the other hand, can be applied to a printer employing an intermediate transfer method once transferring a developer image formed by each of development units to a primary transfer belt 58 and then transferring the developer image to a medium S conveyed by a pair of secondary transfer rollers 59 as illustrated in FIG. 17. Components and configurations similar to the above embodiments will be given the same reference numerals as above, and description thereof will be omitted. According to the third embodiment, the medium S is described as a sheet such as a printing sheet. However, the medium S is not limited thereto. For example, the medium S may be an intermediate transfer belt.

According to the third embodiment, each of the development units is disposed with respect to a drive direction of the primary transfer belt 58 in the order of Y development unit 19, M development unit 20, C development unit 21, W development unit 41, and Bk development unit 18 as illustrated in FIG. 17. The developer images formed by the respective development units are sequentially transferred to the primary transfer belt 58 and then transferred to the medium S by the secondary transfer roller pair 59. Therefore, the image formed on the medium S is substantially the same as the print image according to the second embodiment, that is, the same result as illustrated in FIG. 13 can be obtained.

The third embodiment of the present invention has been described above. However, the third embodiment may be modified as follows:

Modification 7

In the printer employing the intermediate transfer method according to the third embodiment, the electrostatic force can cause the background design pattern image 3A to be partially transferred to the medium S before the background design pattern image 3A reaches a portion between the pair of secondary transfer rollers 59. Herein, a description is given of protection of the background design pattern image 3A in the printer employing the intermediate transfer method as the modification 7 of the third embodiment.

Figure 18:
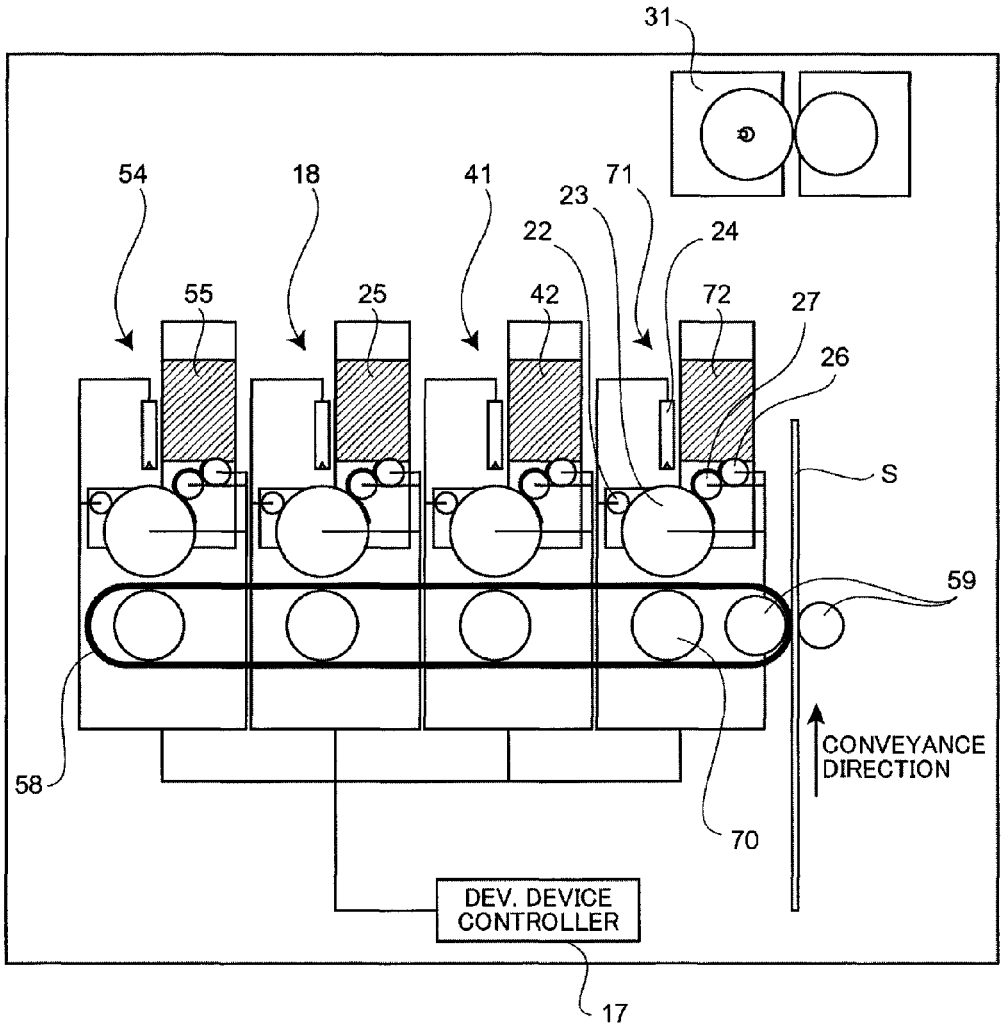
FIG. 18 is a schematic diagram illustrating the print unit according to a modification of the third embodiment.

Referring to FIG. 18, the print unit in the printer according to the modification 7 is illustrated. Herein, a description is given using an example case where the monochrome printing is performed by four development units with a composite black developer 72 made of the Y, M, and C developers mixed beforehand.

Each of the development units is disposed with respect to a drive direction of the primary transfer belt 58 in the order of a composite black development unit 71, a W development unit 41, and a Bk development unit 18, and a protection layer development unit 54 as illustrated in FIG. 18. The protection layer development unit 54 uses a transparent developer 55.

Figure 19:
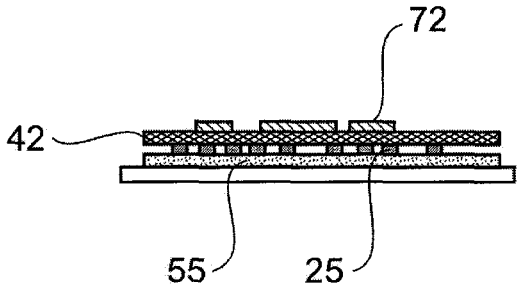
FIG. 19 is a schematic cross-sectional view illustrating a developer layer formed on the medium.
Figure 20:
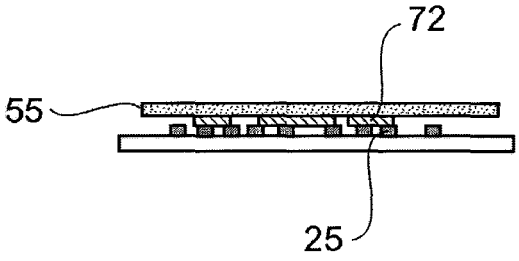
FIG. 20 is a schematic cross-sectional view illustrating a developer layer formed on the medium according another modification of the third embodiment.

Referring to a cross-sectional view of FIG. 19, a description is given of an example of a developer layer formed on the medium S by the printer of the modification 7. According to the modification 7, when the developer images are transferred from the primary transfer belt 58 to the medium S, the protection developer 55 formed on the uppermost layer may have the possibility of being transferred while the background design pattern image 3A and the print image cannot be disturbed even in case of absorbing the developer image to the side of the medium S before the developer laminated on the primary transfer belt 58 partially reaches the portion between the pair of secondary transfer rollers 59. The monochrome printing is described as an example of the modification 7. However, the modification 7 may be applied to the color printing by disposing color development units of respective colors of yellow, magenta, and cyan to the composite black development unit 71.

Modification 8

According to the above modification 7, the protection layer development unit 54 is disposed to form the protection layer protecting the background design pattern image 3A. According to a modification 8, each of the development units is disposed with respect to the conveyance direction of the medium S of the modification 7 in the order of the protection layer development unit 54, a print image formation development unit such as a composite black development unit 71 forming a print image, and a Bk development unit 18 forming a background design pattern image 3A.

Referring to FIG. 10, an example of a developer layer formed by a printer having the structure of the modification 8 is illustrated in a cross-sectional view. Since the development units are disposed in the order described above, an entire surface of the image can be protected. Alternatively, in a case where a W development unit 41 is disposed between the print image formation development unit and the Bk development unit 18, the background design pattern image 3A can be hidden as similar to the second embodiment while protecting the print image.

According to the third embodiment, therefore the first and second embodiments of the present invention described above can be applied to the printer employing the intermediate transfer method. The third embodiment including the modifications of the present invention can obtain the same advantages as described in the first and second embodiments.

Particularly, the present invention is effective in a case where information embedded by absorption of the developer forming the background design pattern image is read by irradiation of the light having a wavelength of an infrared region, for example, Anoto printing (available by Anoto group AG) and Gridmark printing (available by Gridmark Ltd.).

According to each of the first, second, and the third embodiments, the present invention is applied to the printer employing the electrophotographic method. However, the present invention is not limited thereto. The present invention can be applied to, for example, a printer, a photocopier, and a facsimile device employing the electrophotographic method, an ink jet method, or a heat transfer method.

As can be appreciated by those skilled in the art, numerous additional modifications and variation of the present invention are possible in light of the above-described teachings. It is therefore to be understood that, within the scope of the appended claims, the disclosure of this patent specification may be practiced otherwise than as specifically described herein.

What is claimed is:

1. An image forming apparatus comprising:

a first development unit performing a development with a first developer absorbing a light having a prescribed wavelength;

a plurality of second development units performing the development with second developers having a different color respectively, permeating the light having prescribed wavelength therethrough;

a communication unit receiving print data including background design image data and print image data;

a control unit controlling print of the background design image data by the first development unit and print of the print image by the second development units;

an analyzing unit determining whether or not the received print data includes the background design image data; and an image data conversion unit converting a portion of the print image data to be printed with the first developer into the portion of the print image data to be printed with a combination of the second developers in a case where the print data includes the background design image data according to a determination result at the analyzing unit, wherein, in a case where the print data includes the background design image data, the control unit controls to form an image of the background design image data by the first development unit, and to form an image of the print image data by the second development units, and wherein, in a case where the print data does not include the background design image data, the control unit controls to form the image of the print image data by both of the first development unit and the second development units.

2. The image forming apparatus according to claim 1, wherein the second development unit forms an image corresponding to the print image.

3. The image forming apparatus according to claim 1, wherein the prescribed wavelength light is an infrared light.

4. The image forming apparatus according to claim 3, wherein the second developer includes any of titanium dioxide compound having high permeability of infrared ray, isoindoline, quinophthalone, quinacridone, carmine, copper phthalocyanine, and anthraquinone.

5. The image forming apparatus according to claim 1, wherein the first developer includes a carbon black.

6. The image forming apparatus according to claim 1 further comprising:

a conveyance unit conveying a medium on which the first developer image and the second developer image to be transferred, wherein the control unit controls the print of the background design image by the first developer unit and the print of the print image by the second development unit among the first and second developer images to be transferred to the medium conveyed by the conveyance unit, and wherein the second developer image is formed on an upper layer of the first developer image when the first and second developer images formed by the respective first and second development units are printed based on the control by the control unit.

7. The image forming apparatus according to claim 6, wherein the control unit allows the second developer image covering the first developer image to be printed.

8. The image forming apparatus according to claim 1, wherein the second development unit includes a hiding image development unit forming a hiding image hiding the background design image formed by the first development unit.

9. The image forming apparatus according to claim 1, wherein the second development unit further includes a protection image development unit forming a protection image protecting the background design image formed by the first development unit.

10. The image forming apparatus according to claim 1, wherein the first developer image and the second developer image are printed on a medium by a direct transfer method.

11. The image forming apparatus according to claim 1, wherein the first developer image and the second developer image are printed on a medium by an intermediate transfer method.

12. The image forming apparatus according to claim 1, wherein the first developer is a black developer, and the plurality of second developers having a different color are a yellow developer, a magenta developer, and a cyan developer respectively, wherein a portion of the print image data to be printed with the black developer is printed with a combination of the yellow developer, the magenta developer, and the cyan developer in a case where the print data includes the background design image data.

13. The image forming apparatus according to claim 1, wherein a thickness of the developer layer formed on the print image by the first development unit is thicker than the thickness of the developer layer formed on the print image by the second development units.

14. An image forming system comprising:

an image forming apparatus including:

a first development unit performing a development with a first developer absorbing a light having a prescribed wavelength;

a plurality of second development units performing the development with second developers having a different color respectively, permeating the light having prescribed wavelength therethrough;

a communication unit receiving print data including background design image data and print image data;

a control unit controlling print of the background design image data by the first development unit and print of the print image by the second development units;

an image reading apparatus reading the background design image data using the light having the prescribed wavelength;

an analyzing unit determining whether or not the received print data includes the background design image data; and an image data conversion unit converting a portion of the print image data to be printed with the first developer into the portion of the print image data to be printed with a combination of the second developers in a case where the print data includes the background design image data according to a determination result at the analyzing unit, wherein, in a case where the print data includes the background design image data, the control unit controls to form an image of the background design image data by the first development unit, and to form an image of the print image data by the second development units, and wherein, in a case where the print data does not include the background design image data, the control unit controls to form the image of the print image data by both of the first development unit and the second development units.

15. The image forming apparatus according to claim 14, wherein the first developer is a black developer, and the plurality of second developers having a different color are a yellow developer, a magenta developer, and a cyan developer respectively, wherein a portion of the print image data to be printed with the black developer is printed with a combination of the yellow developer, the magenta developer, and the cyan developer in a case where the print data includes the background design image data.

16. The image forming apparatus according to claim 14, wherein a thickness of the developer layer formed on the print image by the first development unit is thicker than the thickness of the developer layer formed on the print image by the second development units.

* * * * *